US006752099B1

(12) United States Patent
Crifase et al.

(10) Patent No.: US 6,752,099 B1
(45) Date of Patent: Jun. 22, 2004

(54) BOAT LANDING APPARATUS WITH REMOVABLE WINCH

(76) Inventors: Philip A. Crifase, 5329 Main St., Apt. 406, Downers Grove, IL (US) 60515; Joy P. Crifase, 5329 Main St., Apt. 406, Downers Grove, IL (US) 60515

( * ) Notice: Subject to any disclaimer, the term of this patent is extended or adjusted under 35 U.S.C. 154(b) by 0 days.

(21) Appl. No.: 10/657,937

(22) Filed: Sep. 9, 2003

Related U.S. Application Data

(63) Continuation-in-part of application No. 10/277,321, filed on Oct. 22, 2002, now Pat. No. 6,644,231.

(51) Int. Cl.[7] ..... B63B 59/02
(52) U.S. Cl. ..... 114/219
(58) Field of Search ..... 280/414.1–414.3; 114/219; 405/1–7

(56) References Cited

U.S. PATENT DOCUMENTS 2,658,354 A 11/1953 Lee ..... 61/67
4,092,755 A * 6/1978 Hughes ..... 114/344
4,148,465 A * 4/1979 Bowman ..... 254/334
5,449,247 A * 9/1995 Smith ..... 405/3
5,460,112 A 10/1995 Travioli ..... 114/230
6,637,975 B2 * 10/2003 Foxwell ..... 405/2
6,644,231 B2 * 11/2003 Crifase et al. ..... 114/219

* cited by examiner

*Primary Examiner*—Ed Swinehart
(74) *Attorney, Agent, or Firm*—Donald J. Ersler

(57) ABSTRACT

A removable winch may be used in combination with any embodiment of the boat landing apparatus. The removable winch may be attached directly to the boat landing apparatus or may be retained adjacent the boat landing apparatus. The removable winch includes a removable winch assembly and a retention tube. The retention tube is inserted into the ground, if not attached to the boat landing apparatus. However, the retention tube is preferably inserted into the ground, if attached to the boat landing apparatus. The removable winch assembly includes a retention projection and a winch. The retention projection is sized to be received by the retention tube.

4 Claims, 27 Drawing Sheets

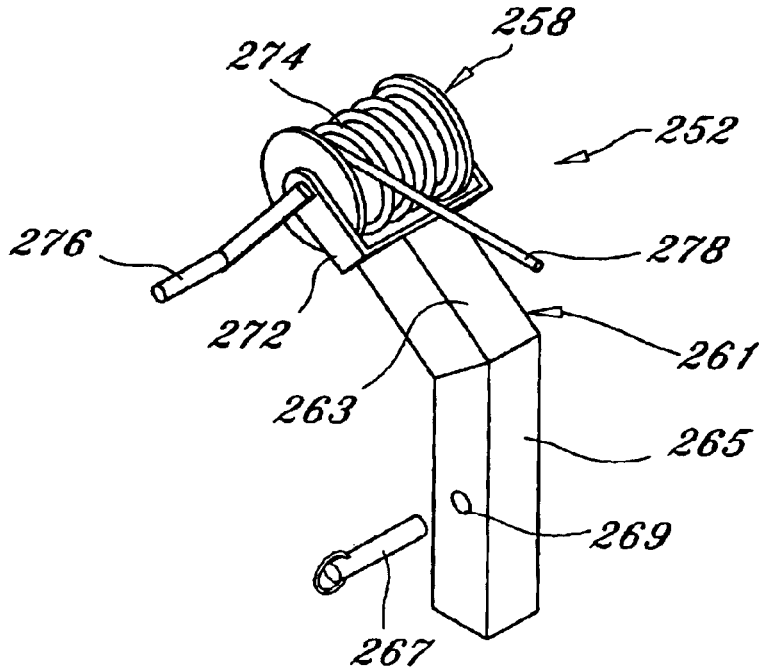
FIG. 41
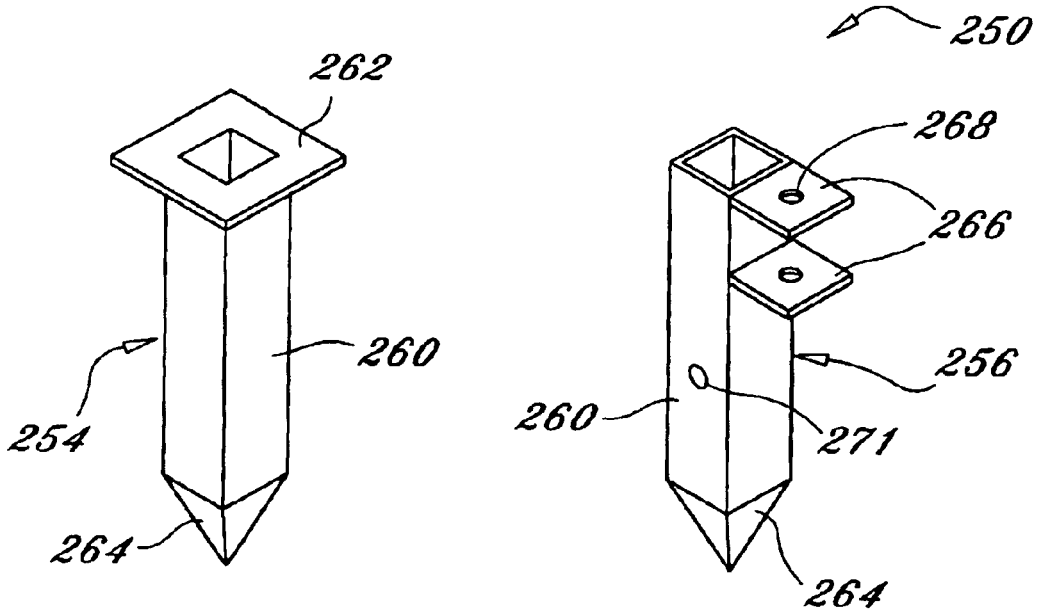

BOAT LANDING APPARATUS WITH REMOVABLE WINCH

CROSS-REFERENCES TO RELATED APPLICATIONS

This is a continuation-in-part application of Ser. No. 10/277,321 filed on Oct. 22, 2002 now U.S. Pat. No. 6,644,231.

BACKGROUND OF THE INVENTION

1. Field of the Invention

The present invention relates generally to landing a boat on shore and more specifically to a boat landing apparatus which may be used to easily land and retain a boat.

2. Discussion of the Prior Art

There are numerous boating landing devices such as U.S. Pat. No. 2,658,354 to Lee, U.S. Pat. No. 5,449,247 to Smith, and U.S. Pat. No. 5,460,112 to Travioli. All three of the these patents have the same drawback. Only a small length of the boat is guided when the boat is in contact with the boat landing device. A boat landing device which only contacts a small length of the boat lacks stability. Another problem occurs to a small boat when it rains. If it rains hard enough, the small boat anchored at a pier will fill with rain water and sink. The alternative is to pull the boat on to the shore. However, this is an inconvenient and time consuming process.

Accordingly, there is a clearly felt need in the art for a boat landing apparatus which provides greater stability when landing a boat than that of the prior art.

SUMMARY OF THE INVENTION

The present invention provides a boat landing apparatus which is easier to use than that of the prior art. The boat landing apparatus includes a pair of roller assemblies, a pair of cross members, four cross member brackets, and at least two retention stakes. Each roller assembly includes a plurality of rollers pivotally retained in a roller frame. Each cross member bracket is mounted to substantially each end of each roller assembly. A wedge spacer may be mounted to a bottom of the roller frame before attachment of the cross member bracket. The wedge spacer enables the roller assembly to have an inward tilt. An opening is formed through substantially a center of the bracket and the roller frame. Each cross member bracket is sized to slidably receive the perimeter of the cross member. Each cross member has a plurality of openings formed along a length thereof. The width of the boat landing apparatus may be adjusted by aligning the opening in the roller frame with one of the openings in the cross member. A single stake is then inserted through the openings in the roller assembly and cross member into the mounting surface.

A height spacer may be used to tilt the boat landing device. The height spacer allows the boat landing apparatus to be tilted for raising or lowering either end of the boat. The rear of the boat may be tilted downward to drain water therefrom, if necessary. The height spacer preferably includes a post retainer, a tubular post, and a flange retainer. A single post retainer is attached to a bottom of each end of each roller assembly. The tubular post is retained by the post retainer. The flange retainer is clamped to the tubular post to prevent thereof from sinking into the lake bottom.

A second embodiment of the boat landing apparatus includes a pair of roller assemblies, at least two cross members, at least four support brackets, at least four support posts, and at least four support spacers. Each roller assembly includes a plurality of rollers pivotally retained in a roller frame. One end of each roller assembly is mounted to one of the cross members and the other end of each roller assembly is mounted to the other cross member. Additional cross members may be used to support extra weight. A wedge spacer may be inserted between a bottom of the roller frame and a top of the cross member. The wedge spacer enables the roller assemblies to have an inward tilt. A single support bracket is secured to each end of each cross member. A single support post is secured to a bottom of each support bracket. A single support spacer is attached to each support post.

The second embodiment of the boat landing apparatus is preferably installed as follows. The support posts are located and then inserted into a bottom of the body of water. A single support spacer is then-slid on to each support post. The support spacers are then pushed against the bottom of the body of water and secured to the support posts. A single support bracket is attached to a top of each support post. Each cross member is slid through a pair of support brackets and secured thereto. The pair of roller assemblies are then attached to the cross members. A single guide post may be attached to a top of each support bracket. A boat may be tied to at least one guide post. Providing at least two cross members with a sufficient length will allow an access plank to mounted thereto. The second embodiment of the boat landing apparatus may also be assembled and then placed on a bottom of a body of water.

A boat landing apparatus with elevation device includes a boat landing apparatus and at least one elevation device. Either embodiment of the boat landing device disclosed in this application may be used. The at least one elevation device may be attached to a front, rear, or to both front and rear of the boat landing apparatus. Each elevation device includes a drive shaft, a pair of elevating arms, a pair of elevating rollers, and a drive assembly. The drive shaft is pivotally retained by a pair of roller assemblies. The pair of elevating rollers are pivotally retained by one end of each elevating arm and the other end of each elevating arm is rigidly attached to the drive shaft. The drive assembly is used to rotate the drive shaft such that thereof rotates the elevating roller into an elevated orientation. The pair of elevating rollers are preferably contoured to receive a bottom of the boat.

The drive assembly preferably includes a gear reduction drive, at least one ratchet gear, and a ratchet arm. The gear reduction drive provides a mechanical advantage to the crank. The at least one ratchet gear retains the pair of elevating rollers in an elevated orientation. The ratchet arm will be rotated several times to provide a small amount of angular movement to the drive shaft. A direct drive assembly may be used instead of the drive assembly. The direct drive assembly does not include gear reduction. A reversible ratchet gear may be used instead of two ratchet gears.

A third embodiment of the boat landing apparatus includes a pair of roller assemblies, a pair of cross members and a set of four retention brackets. Each roller assembly includes a plurality of rollers pivotally retained in a roller frame. Each roller assembly is mounted to substantially each end of each cross member with a single retention device. A first embodiment of the retention bracket is a surface pivot bracket. Each surface pivot bracket is pivotally mounted to the cross member and an end of a single roller assembly is retained on a top thereof. A pair of curved bearing surfaces are formed on a bottom of the surface pivot bracket. The pair of curved bearing surfaces contact the cross members and supports the weight placed on the roller assembly.

A second embodiment of the retention bracket is a pivot support bracket. Each pivot support bracket is pivotally mounted to the cross member and a single roller assembly is retained on a top thereof. The pivotal connection with the cross member supports the weight placed on the roller assembly. A third embodiment of the retention bracket is a cross bracket. The cross bracket includes a lower attachment leg extending downward from a base member and a upper attachment leg extending upward from the base member. The lower attachment leg is substantially perpendicular to the upper attachment leg. With the cross bracket, a wedge spacer may be inserted between a bottom of the roller assembly before attachment to the cross bracket. The wedge spacer enables the roller assembly to have an inward tilt.

A single stake may be inserted through an opening in the cross member and/or roller assembly for mounting. A support post may be mounted to a bottom of one of the cross members with an angle bracket. The angle bracket includes a first attachment leg and a second attachment leg that extends substantially perpendicular from the first attachment leg. Two roller assemblies may be connected in series with an in-line connector bracket. The in-line connector bracket includes at least one stake extending downward therefrom.

A fourth embodiment of the boat landing apparatus includes a plurality of roller axles, and a pair of retention members. Each roller axle is pivotally retained in the pair of retention members. Each roller axle includes a pair of rollers and an axle. The pair of rollers are preferably secured to the axle with a fastener. The pair of rollers support and guide a boat, which is being launched or pulled in.

A fifth embodiment of the boat landing apparatus preferably includes a plurality of bracket support members, a plurality of pivot roller brackets, and a pair of lengthwise rail members. A pair of the pivot roller brackets are pivotally attached to each bracket support member. Each end of each bracket support member is preferably attached to a single lengthwise rail member with a single angle bracket.

A removable winch may be used in combination with any embodiment of the boat landing apparatus. The removable winch may be attached directly to the boat landing apparatus or may be retained adjacent a front of the boat landing apparatus. The removable winch includes a removable winch assembly and a retention tube. The retention tube is inserted into the ground, if not attached to the boat landing apparatus. However, the retention tube is preferably inserted into the ground, if attached to the boat landing apparatus. The removable winch assembly includes a retention projection and a winch. The retention projection is sized to be received by the retention tube. The retention projection extends from a bottom of the winch. The winch includes a retention yoke, a reel, a crank, a racket mechanism and line. The reel is pivotally retained in the retention yoke and the line is retained on the reel. The crank extends from an end of the reel and rotation thereof is constrained by the racket mechanism.

Accordingly, it is an object of the present invention to provide a boat landing apparatus which provides greater stability when landing a boat than that of the prior art.

It is a further object of the present invention to provide a boat landing apparatus which may be tilted to adjust to a sloped lake bottom.

It is yet a further object of the present invention to provide a boat landing apparatus which allows a boat to be accessed from a side thereof.

It is yet a further object of the present invention to provide a boat landing apparatus which may be pitched to allow a small boat to be drained of rain water.

It is yet a further object of the present invention to provide a boat landing apparatus which allows a boat to be held in a secure position.

It is yet a further object of the present invention to provide a boat landing apparatus which has an adjustable width to accommodate different size boats.

It is yet a further object of the present invention to provide a boat landing apparatus which includes roller assemblies that pivot relative to a pair of cross members.

It is yet a further object of the present invention to provide an in-line connector bracket that enables to roller assemblies to connected in series of a boat landing apparatus.

It is yet a further object of the present invention to provide a fourth embodiment of a boat landing apparatus having a plurality of roller axles retained between a pair of retention members.

It is yet a further object of the present invention to provide fifth embodiment of a boat landing apparatus having a plurality of pivot roller brackets.

It is yet a further object of the present invention to provide an elevation device, which may be used to lift either end of a boat without adjusting a boat landing apparatus.

Finally, it is another object of the present invention to provide a removable winch, which may be used to with a plurality of boat landing apparatuses.

These and additional objects, advantages, features and benefits of the present invention will become apparent from the following specification.

BRIEF DESCRIPTION OF THE DRAWINGS

FIG. 41 is a perspective view of a removable winch assembly, a retention tube and an attachable retention tube for use with a boat landing apparatus in accordance with the present invention.

DETAILED DESCRIPTION OF THE PREFERRED EMBODIMENTS

Figure 1:
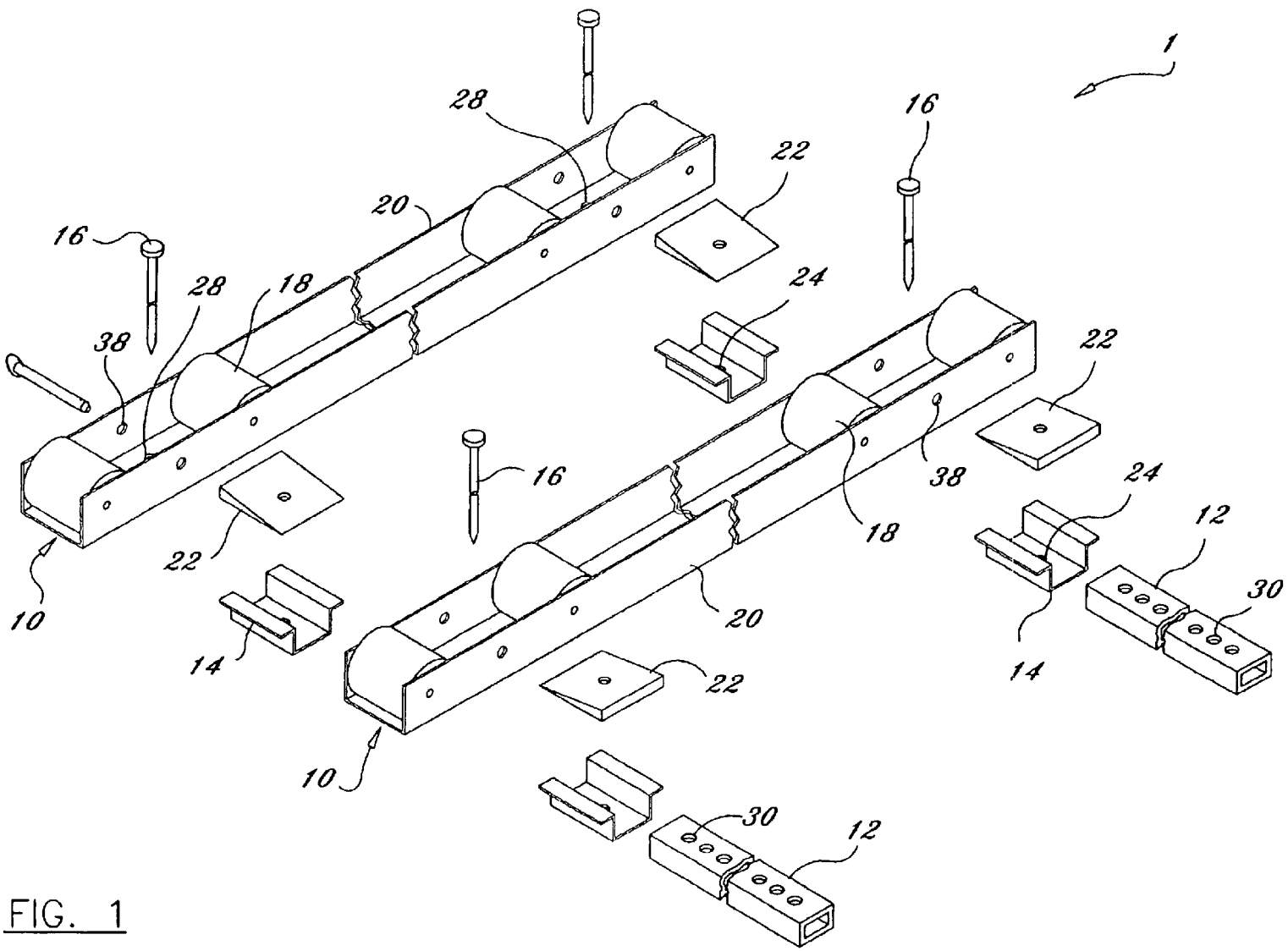
FIG. 1 is an exploded perspective view of a boat landing apparatus in accordance with the present invention.
Figure 2:
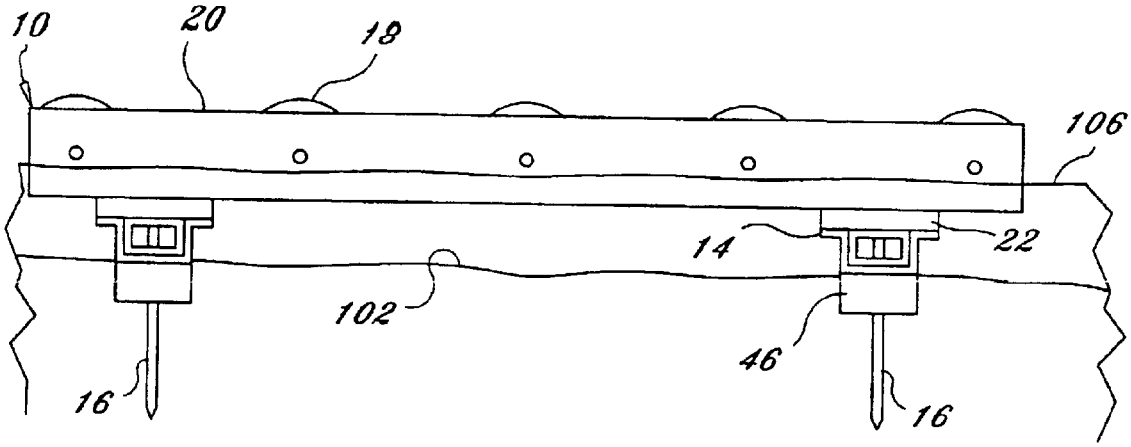
FIG. 2 is a side view of a boat landing apparatus in accordance with the present invention.
Figure 3:
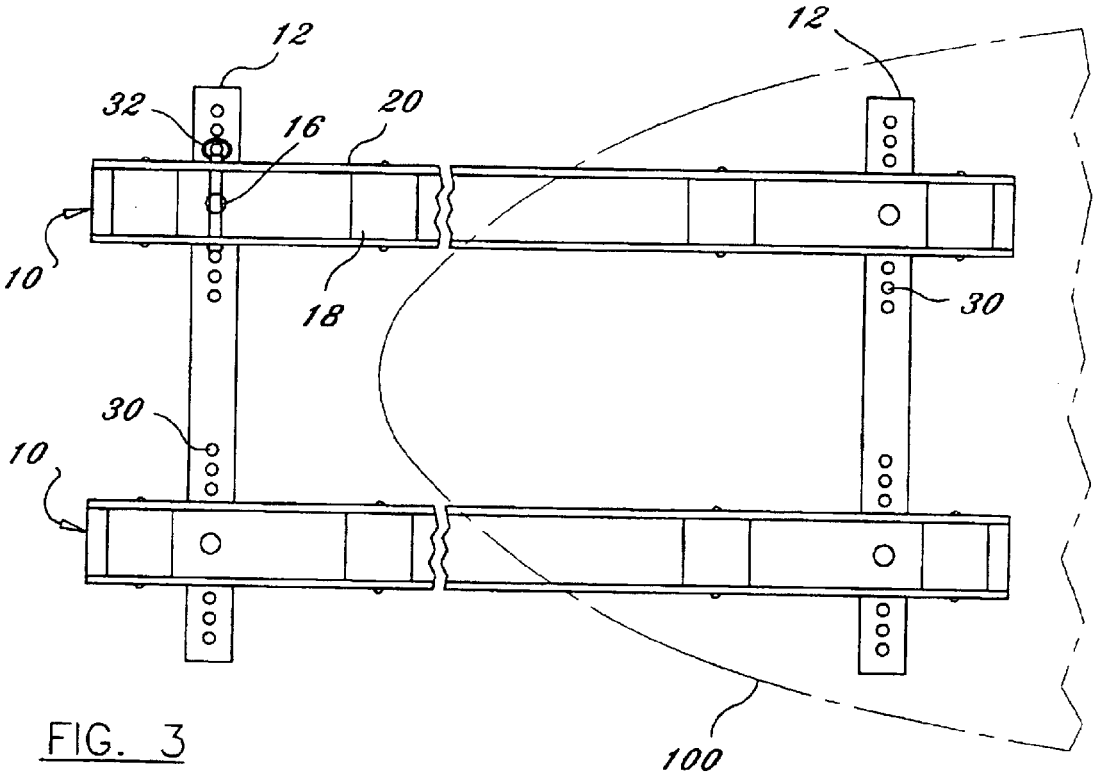
FIG. 3 is a top view of a boat landing apparatus in accordance with the present invention.
Figure 4:
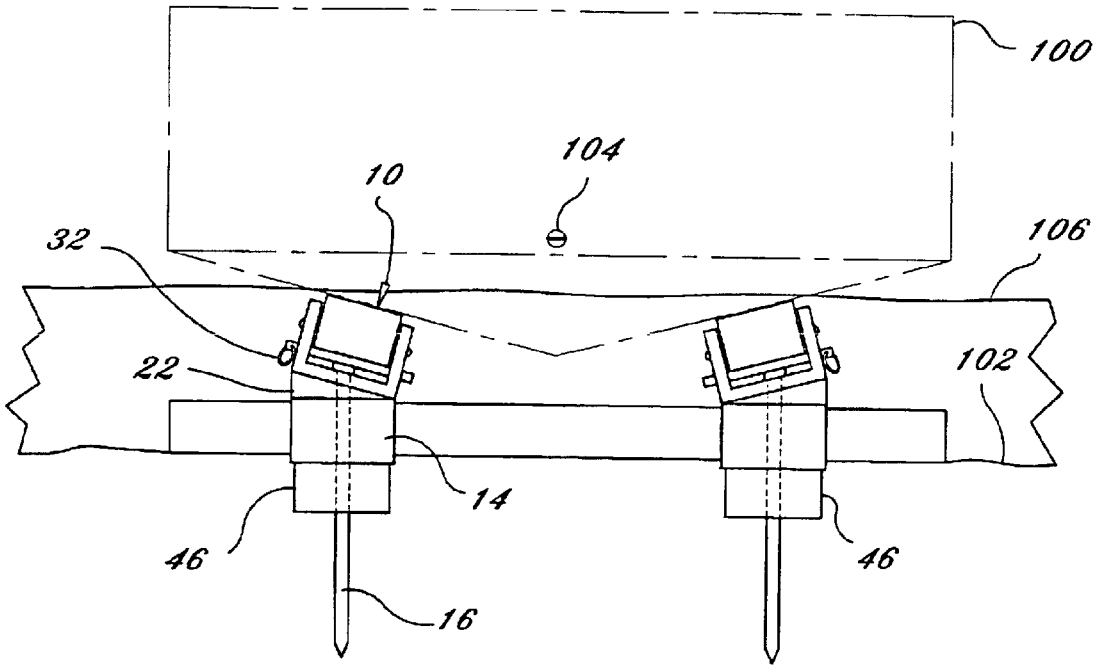
FIG. 4 is a rear view of a boat landing apparatus in accordance with the present invention.

With reference now to the drawings, and particularly to FIG. 1, there is shown an exploded perspective view of a boat landing apparatus 1. With reference to FIGS. 2 and 3, the boat landing apparatus 1 includes a pair of roller assemblies 10, a pair of cross members 12, four cross member brackets 14, and at least two retention stakes 16. Each roller assembly 10 includes a plurality of rollers 18 pivotally retained in a roller frame 20. The roller assembly 10 is preferably purchased from Marine & Trailer Products. One particular design of roller assembly 10 is shown, but other designs of roller assemblies may also be used. A single cross member bracket 14 is mounted to substantially each end of each roller frame 20. The cross member bracket 14 is preferably fabricated from an aluminum sheet stock. Other suitable materials may also be used. A wedge spacer 22 may be mounted to a bottom of the roller frame 20 before attachment of the cross member bracket 14. The wedge spacer 22 enables the roller assembly 10 to have an inward tilt to guide a front of a boat 100 into the boat landing apparatus 1 as shown in FIG. 3. If no tilt is required, then the wedge spacer 22 is not included with the boat landing apparatus 1. The wedge spacer 22 may be fabricated from any material which does not corrode in water.

The cross member bracket 14 and/or the wedge spacer 22 may be attached to a bottom of the roller frame 20 with welding, fasteners, adhesive, or any other suitable assembly process. The cross member bracket 14 may be attached to a bottom of the wedge spacer 22 with welding, fasteners, adhesive, or any other suitable assembly process. An opening 24 is formed through substantially a center of the cross member bracket 14, an opening 26 is formed through the wedge spacer 22, and an opening 28 is formed through substantially each end of the roller frame 20. Each cross member bracket 14 is sized to slidably receive the perimeter of the cross member 12.

Each cross member 12 has a plurality of openings 30 formed along a length thereof. The width of the boat landing apparatus 1 may be adjusted by aligning the opening 28 in the roller frame 20 with one of the openings 30 in the cross member 12. The cross member 12 is preferably fabricated from an rectangular cross section of aluminum tube. Other suitable materials may also be used. A single stake 16 is then inserted through the openings into the mounting surface 102. Each stake 16 preferably has a horizontally serrated surface to enhance retention by the mounting surface 102 such as sand on a lake floor. The stake 16 is preferably fabricated from an aluminum rod. Other suitable materials may also be used. A single post retainer 46 is preferably attached to each end of each roller assembly 10 at a bottom thereof with any suitable assembly process such as welding.

Figure 5:
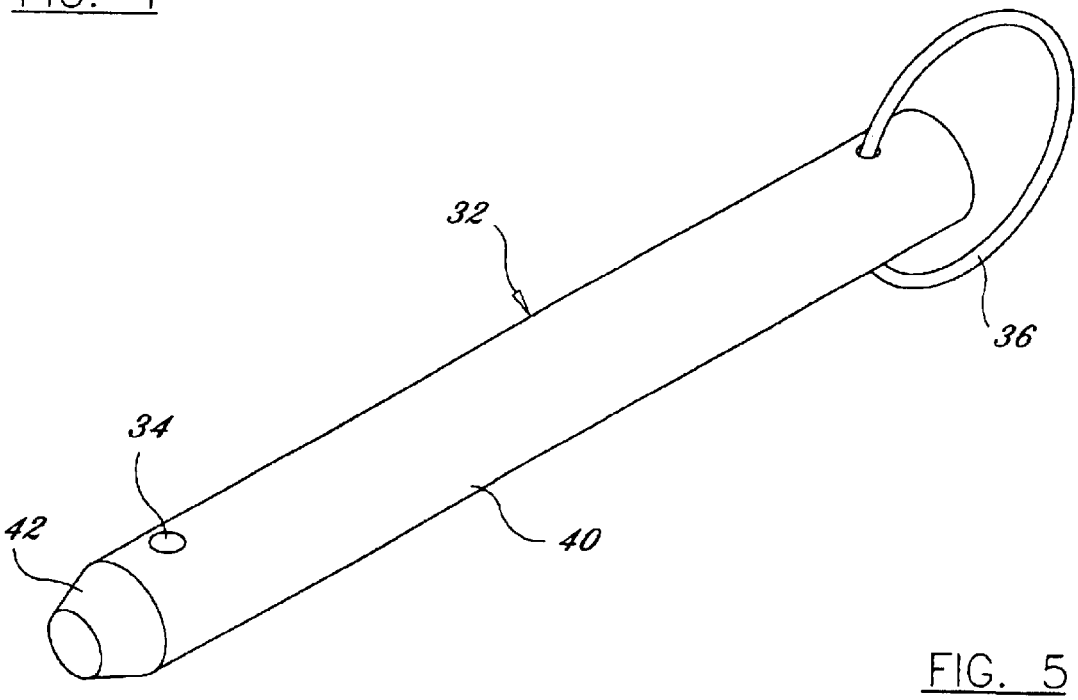
FIG. 5 is a perspective view of a stake retention pin of a boat landing apparatus in accordance with the present invention.

With reference to FIG. 5, preferably a stake pin 32 is utilized to prevent the stake pin 16 from working its way out of the mounting surface 102. A pair of openings 38 are formed through the sides of the roller frame 20 and the stake pin 32 is inserted therethrough. The stake pin 32 preferably includes a pin body 40, a tapered front end 42, at least one spring loaded ball 34 and a withdrawal ring 36 disposed on a rear end. Other methods and devices may also be used to prevent the stake 16 from withdrawing from the mounting surface 102. The stake pin 32 may be purchased as a standard product from a tool component manufacturer.

Figure 6:
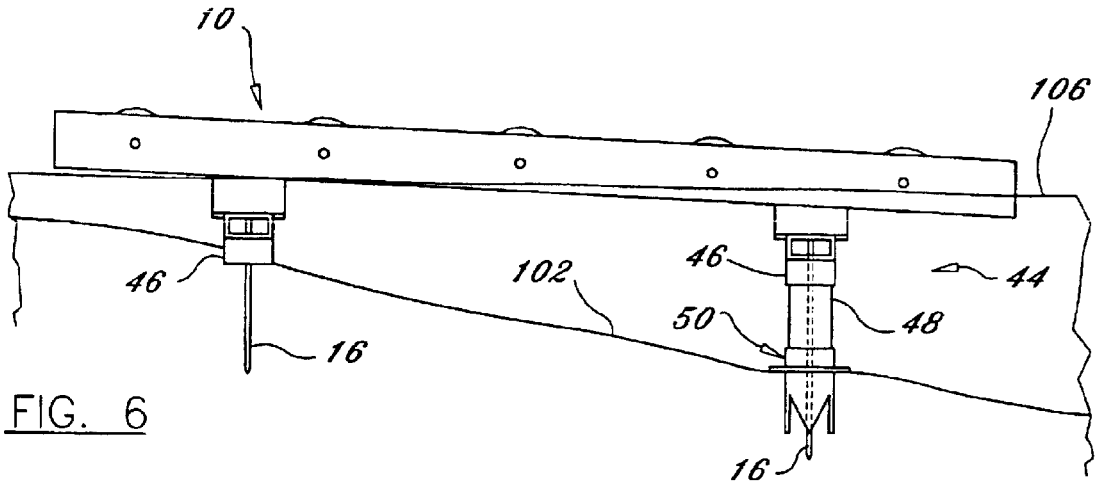
FIG. 6 is a side view of a boat landing apparatus with a pair of height spacers in accordance with the present invention.
Figure 9:
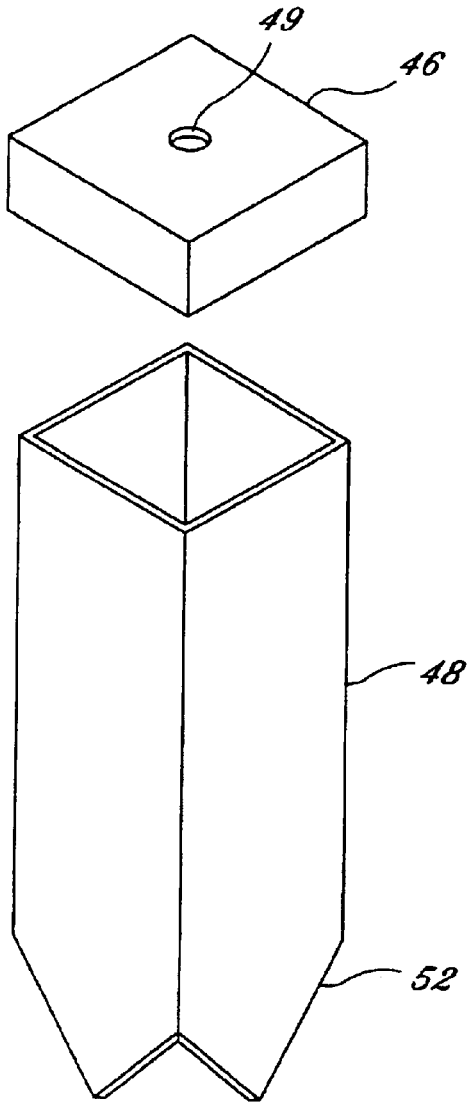
FIG. 9 is a cross sectional view of a post retainer of a boat landing apparatus in accordance with the present invention.
Figure 9:
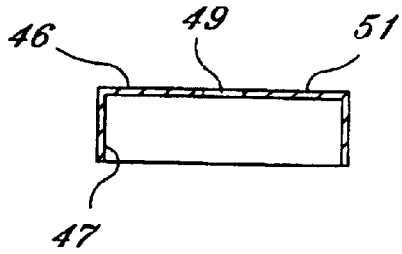
Figure 8:
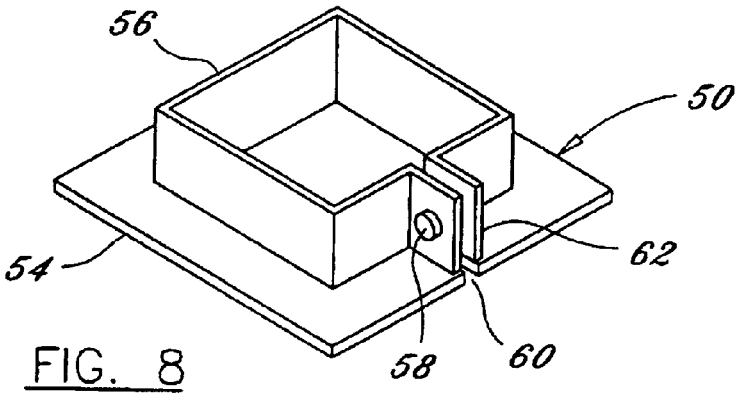
FIG. 8 is an exploded perspective view of a height spacer of a boat landing apparatus in accordance with the present invention.

With reference to FIGS. 6, 8 and 9, a height spacer 44 may be used to adjust the height of one end of the boat landing device 1. The height spacer 44 preferably includes a tubular post 48 and a flange retainer 50. The post retainer 46 is preferably a tubular device with a top portion 51. The post retainer has an inner perimeter 47 which is sized slidably receive the tubular post 48. A stake clearance hole 49 is formed through the top portion 51 of the post retainer 46. A point 52 is preferably formed on a bottom of each side of the tubular post 48. The point 52 facilitates insertion of the tubular post 48 into a lake bottom. A square shaped tubular post 48 is shown, but other shapes may also be used.

Figure 7:
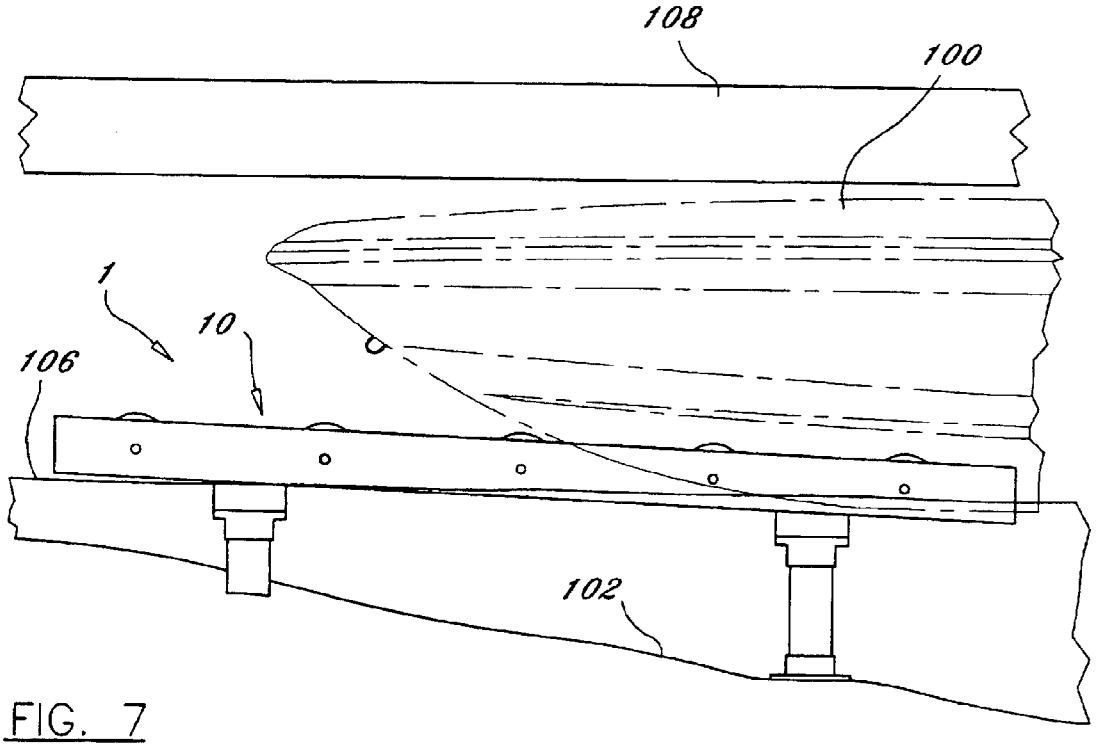
FIG. 7 is a side view of a boat landing apparatus with a boat partially landed thereupon adjacent a pier in accordance with the present invention.

A flange retainer 50 includes a flange plate 54, a clamp 56, and a fastener 58. The clamp 56 is preferably attached to a top of the flange plate 54 with any suitable assembly process such as welding. A slit 60 is formed in the flange plate 54 adjacent a tightening flange 62. The slit 60 allows the clamp to be tightened around the tubular post 48. The attachment of the flange retainer 50 to the tubular post 48 prevents the rear of the boat landing apparatus 1 from sinking into a lake bottom. The fastener 58 is used to tighten the clamp 50 against the tubular post 48. The post retainer 46, tubular post 48, and flange retainer 50 are preferably fabricated from any material which does not corrode in water. Other designs of height spacers may also be used. FIG. 7 shows a boat 100 pulled half way on to a boat landing apparatus 1 adjacent a pier 108.

Figure 10:
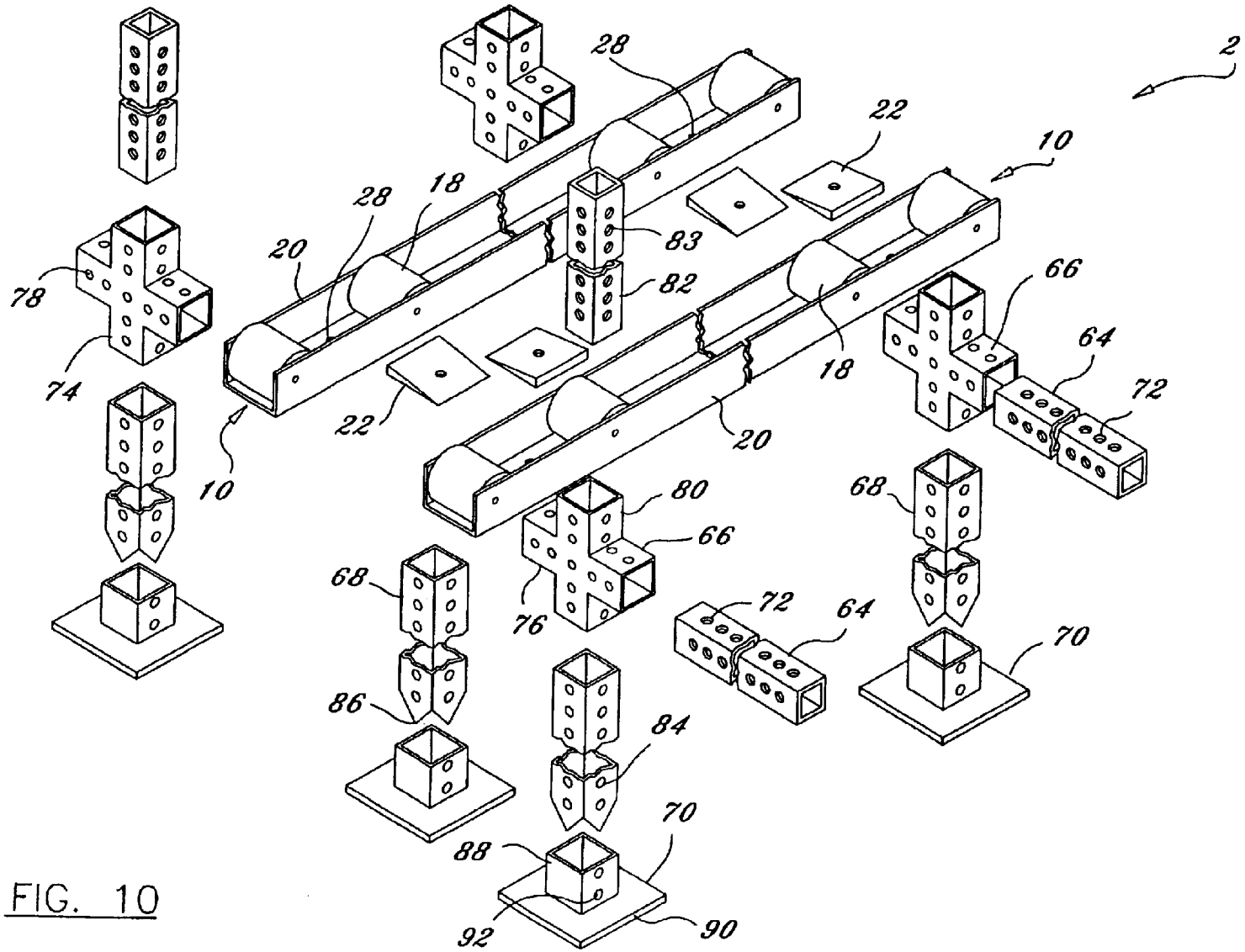
FIG. 10 is an exploded perspective view of a second embodiment of a boat landing apparatus in accordance with the present invention.

FIG. 10 shows a second embodiment of the boat landing apparatus 2. The boat landing apparatus 2 includes a pair of roller assemblies 10, at least two cross members 64, at least four support brackets 66, at least four support posts 68, and at least four support spacers 70. Two cross members 64 and four support posts 68 are preferable, but more could be used. Each roller assembly 10 includes a plurality of rollers 18 pivotally retained in a roller frame 20. Each cross member 64 is preferably a rectangular tube with a plurality of holes 72 formed through the sides thereof. Each support bracket 66 preferably has a support flange 74 mounted substantially perpendicular to a bottom of a cross tube 76. An inner perimeter of the support flange 74 receives a single support post 68. The inner perimeter of the cross tube 76 receives a single cross member 64. A guide flange 80 may be mounted to a top of the cross tube 76 to receive a guide post 82. A plurality holes 83 are preferably formed through the sides of the guide post 82. Each support bracket 66 includes a plurality holes 78 formed therethrough. The cross tube 76 is preferably fabricated from a first rectangular tube and the support flange 74 from a second rectangular tube. The guide flange 80 is preferably fabricated from a third rectangular tube.

Each support post 68 has a plurality of holes 84 formed through the sides thereof. Preferably, a bottom end of each support post 68 has at least one side sharpened to a point 86 to facilitate insertion into a bottom of a body of water. Other sharpening schemes may also be used besides that disclosed in FIGS. 10–13. A single support spacer 70 includes a support flange 88 and a support foot 90. At least one hole 92 is formed through the post flange 88. The support spacers 70 prevent the boat landing apparatus 2 from sinking into the bottom of the body of water with reference to FIG. 13, the boat landing apparatus 2 is preferably mounted with a backward pitch. The backward pitch allows water 110 trapped in the back of the boat to drain out through a drain opening 112.

Figure 11:
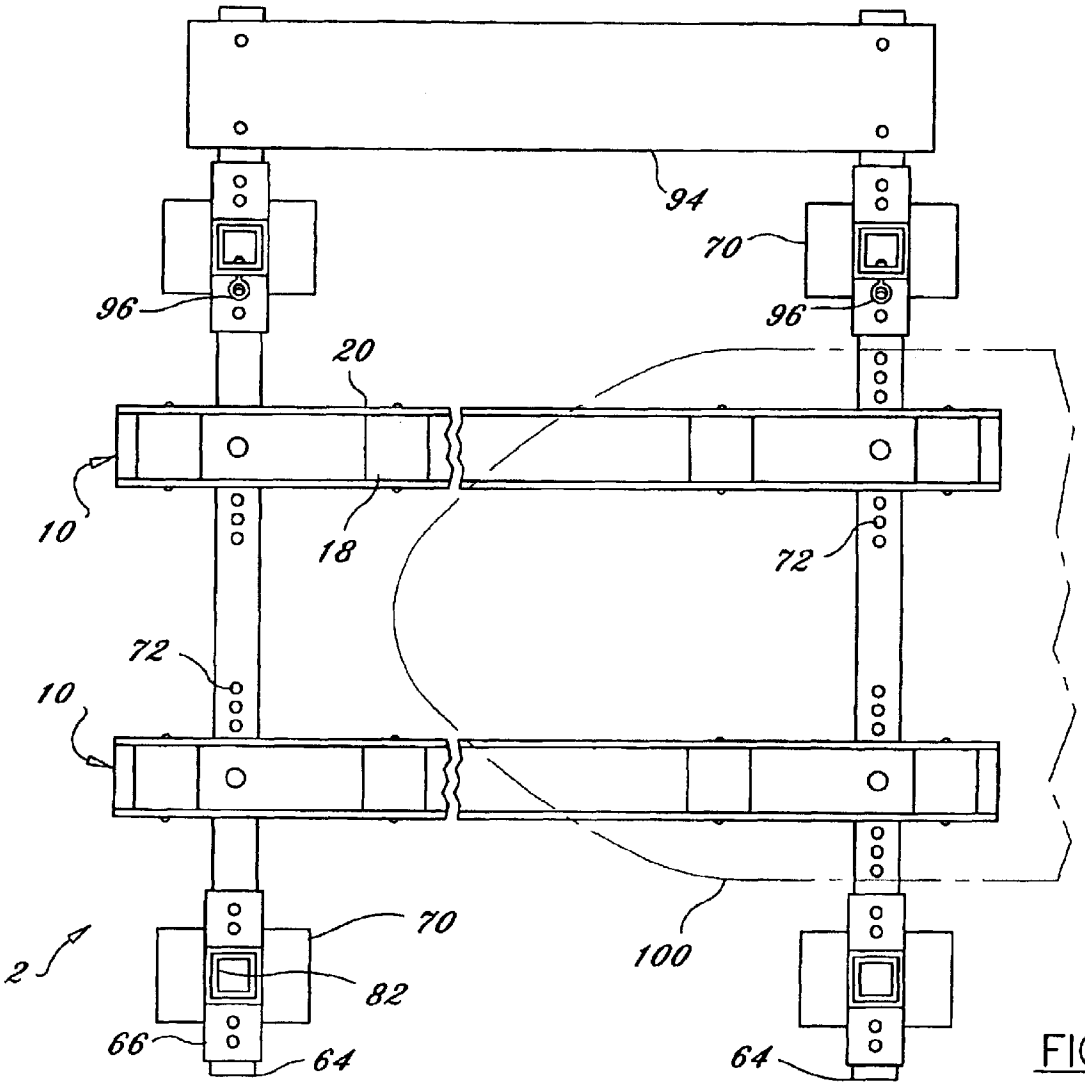
FIG. 11 is a top view of a second embodiment of a boat landing apparatus in accordance with the present invention.
Figure 12:
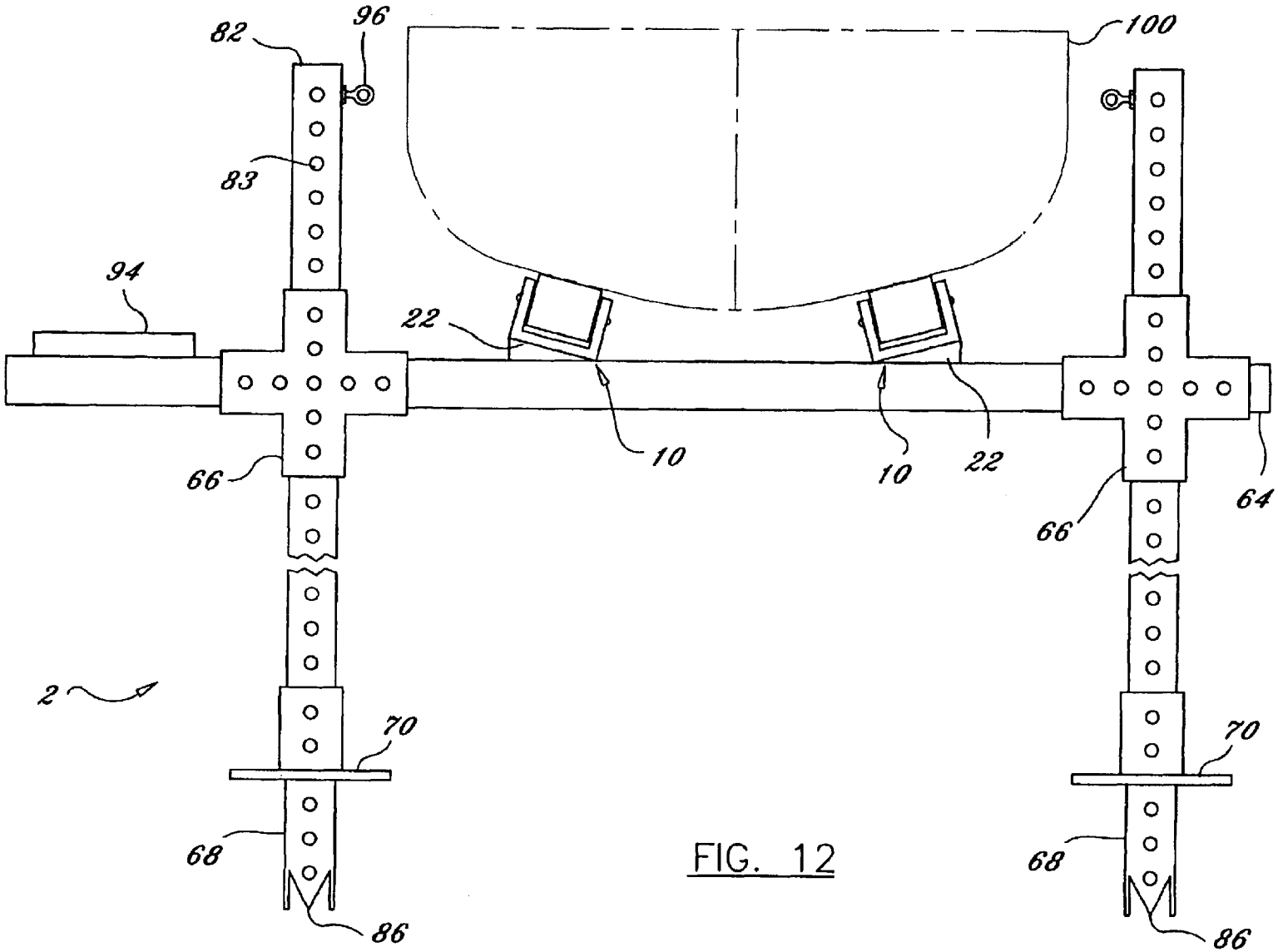
FIG. 12 is a front view of a second embodiment of a boat landing apparatus in accordance with the present invention.
Figure 13:
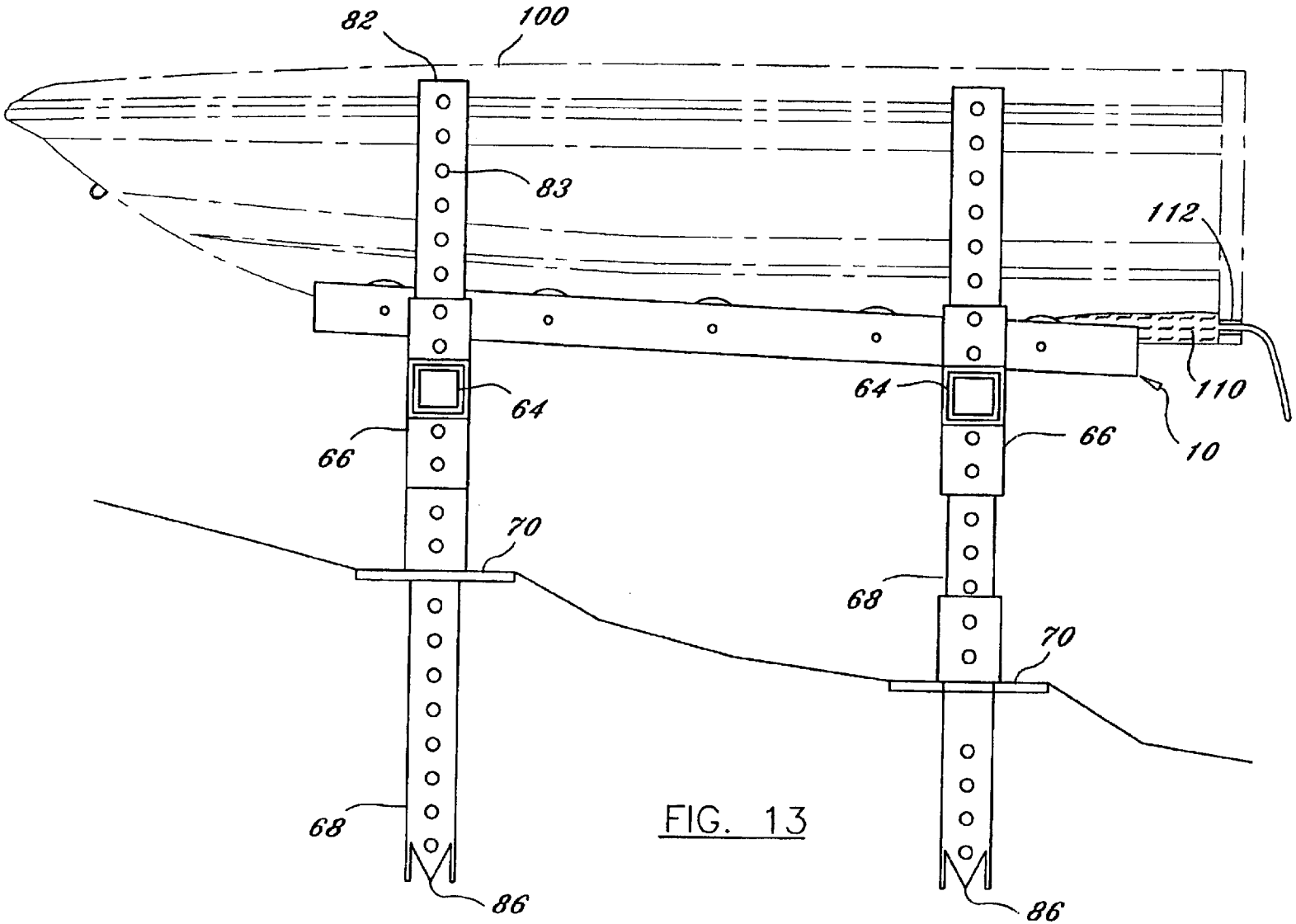
FIG. 13 is a side view of a second embodiment of a boat landing apparatus in accordance with the present invention.

With reference to FIGS. 11–13, one end of each roller assembly 10 is mounted to one of the cross members 64 with any suitable fastener and the other end of each roller assembly 10 is mounted to the other cross member 64 with any suitable fastener. The wedge spacers 22 are placed between a bottom of the roller frames 20 and a top of the cross members 64; the wedge spacers 22 enable the pair of roller assemblies 10 to have an inward tilt. A single support bracket 66 is secured to each end of each cross member 10 with any suitable fasteners. A single support post 68 is inserted into the post flange 74 of each support bracket 66 and secured thereto with any suitable fasteners. A post flange 88 of a single height spacer 70 is slid on to each support post 68 and attached thereto with any suitable fasteners. The cross member 64 may be made with a sufficient length such that an access plank 94 may be attached to one end of each cross member 64 with any suitable fasteners.

A guide post 82 may be inserted into the guide flange 80 of at least one support bracket 66. An eye bolt 96 or the like may be fastened in one of the holes 83 of the guide post 82. The boat 100 may be retained by attaching a line to the eye bolt 96. The boat landing apparatus 2 may be installed by first inserting the support posts 68 into a bottom of a body of water and successively assembling the remaining elements of the boat loading apparatus 2 on the installed support posts 68. The boat landing apparatus 2 may also be assembled and then inserted into a bottom of a body of water.

Figure 14:
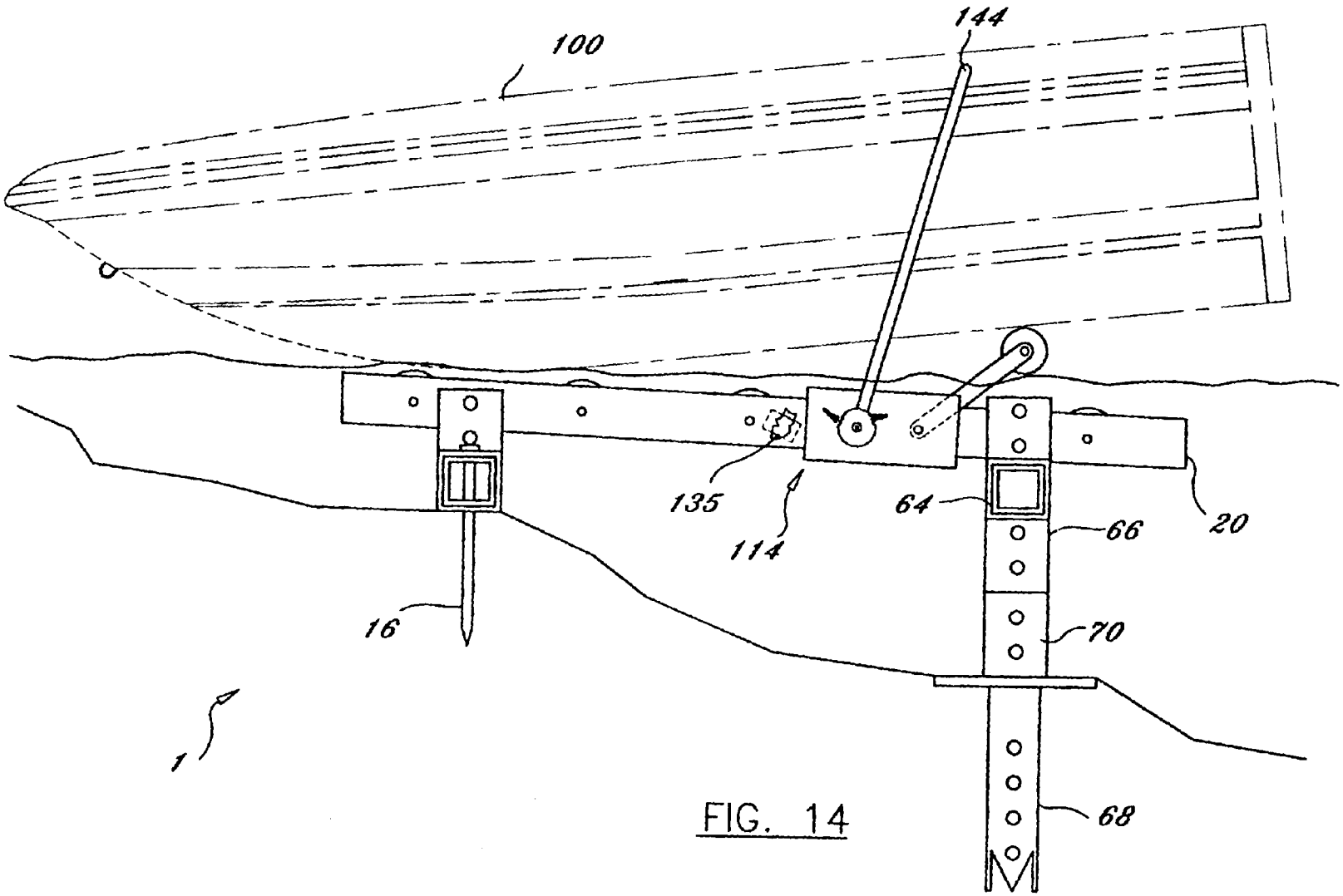
FIG. 14 is a side view of a boat landing apparatus with a elevation device in accordance with the present invention.
Figure 14A:
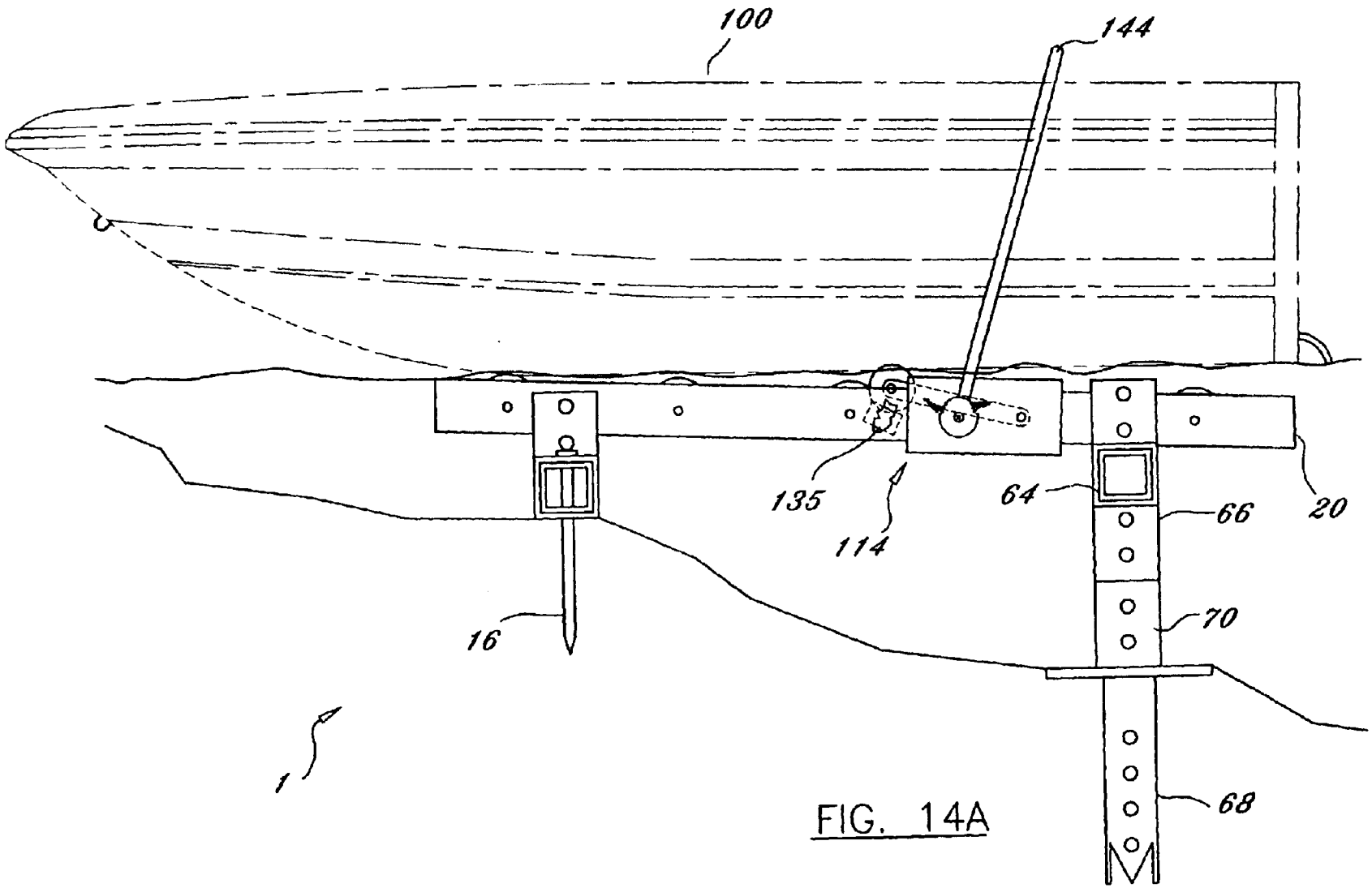
FIG. 14*a* is a side view of a boat landing apparatus with an elevation device rotated in front of a drive shaft in accordance with the present invention.
Figure 15A:
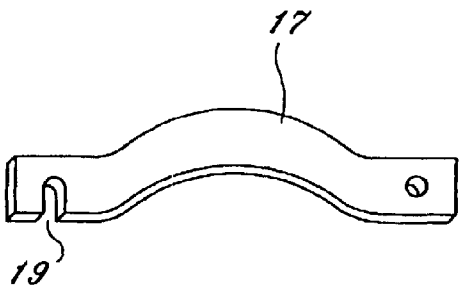
FIG. 15*a* is a perspective view of a stake cover of a boat landing apparatus with an elevation device in accordance with the present invention.
Figure 15:
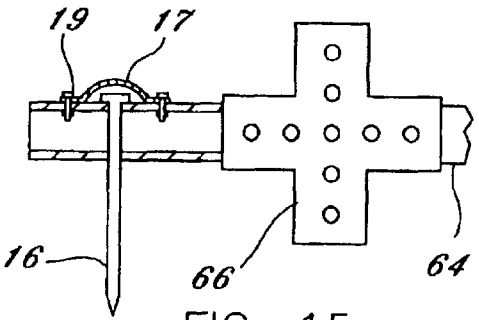
FIG. 15 is a cross sectional view of a stake cover retaining a retention stake used to retain a boat landing apparatus with an elevation device in accordance with the present invention.

With reference to FIGS. 14 and 14*a*, a boat landing apparatus with elevation device 3 includes a boat landing apparatus and at least one elevation device 114. Either embodiment of the boat landing device disclosed in this application may be used. With reference to FIGS. 15 and 15*a*, a stake cover 17 is attached to the cross member 64 with fasteners adjacent the retention stake 16. The stake cover 17 prevents the stake 16 from pushing out of a body of water. The stake cover 17 preferably includes a slot 19 instead of a hole to allow the stake cover 17 to be pivoted after loosening a fastener for removal of a retention stake 16.

Figure 16:
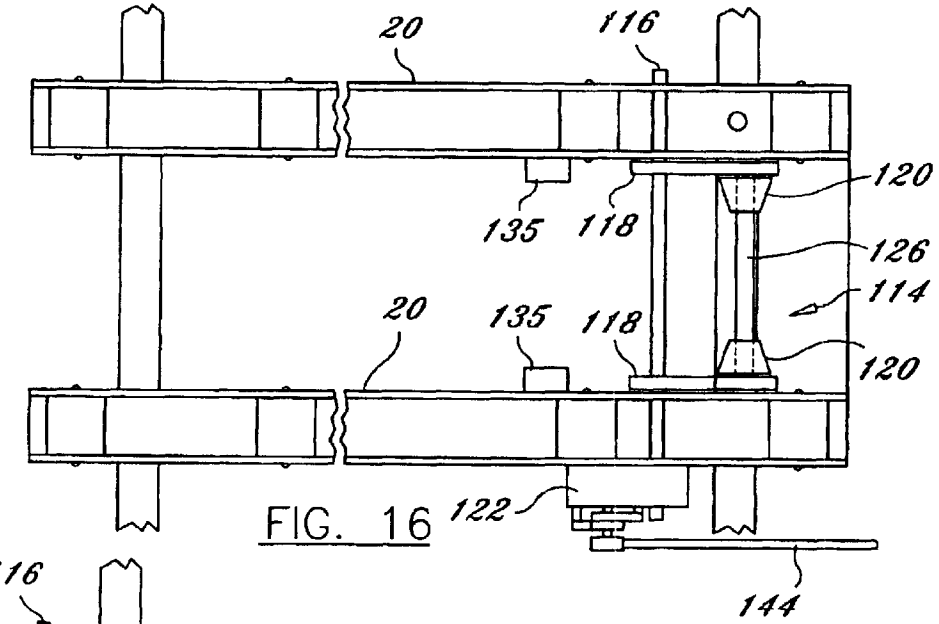
FIG. 16 is a top view of a boat landing apparatus with a elevation device in accordance with the present invention.
Figure 17:
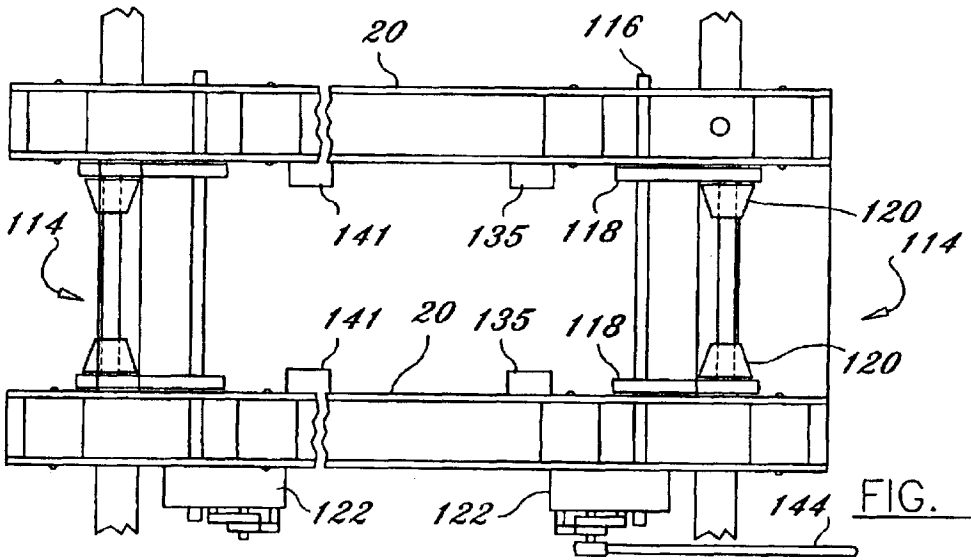
FIG. 17 is a top view of a boat landing apparatus with two elevation devices in accordance with the present invention.
Figure 18:
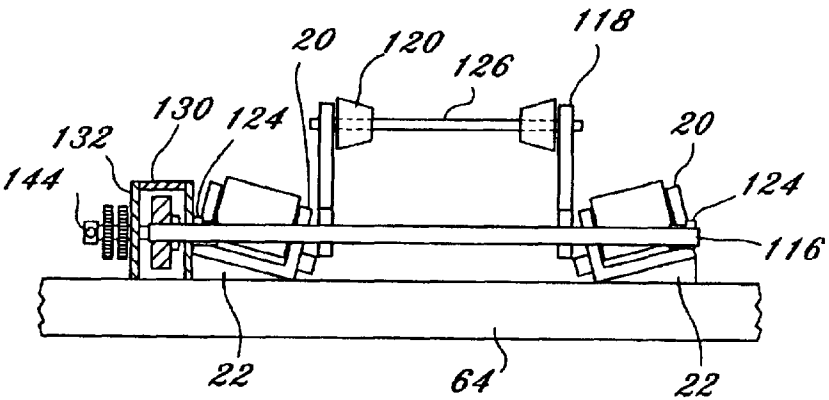
FIG. 18 is an enlarged end view of an elevation device in accordance with the present invention.

With reference to FIGS. 16 and 17, the at least one elevation device 114 may be attached to a front, rear, or to both front and rear of a boat landing apparatus. Each elevation device 114 includes a drive shaft 116, a pair of elevating arms 118, a pair of elevating rollers 120, and a drive assembly. The drive shaft 116 is pivotally retained by the pair of roller frames 20. With reference to FIG. 18, preferably at least one bearing 124 is pressed into each roller frame 20 to provide smooth pivoting for the drive shaft 116.

The pair of elevating rollers 120 are retained by a roller shaft 126 and the roller shaft 126 is retained by each elevating arm 118. The pair of elevating rollers 120 could also be a single contoured roller. The roller shaft 126 may rotate relative to the pair of elevating arms 118. The roller shaft 126 may also be solidly retained by the pair of elevating arms 118 and the pair of elevating rollers 120 rotate relative to the roller shaft 126. The pair of elevating arms 118 are rigidly attached to the drive shaft 116. The drive assembly 122 is used to rotate the drive shaft 116 and thus the pair of elevating rollers 120 into an elevated orientation. The pair of elevating rollers 120 are preferably separated to receive a bottom of a boat.

Figure 19B:
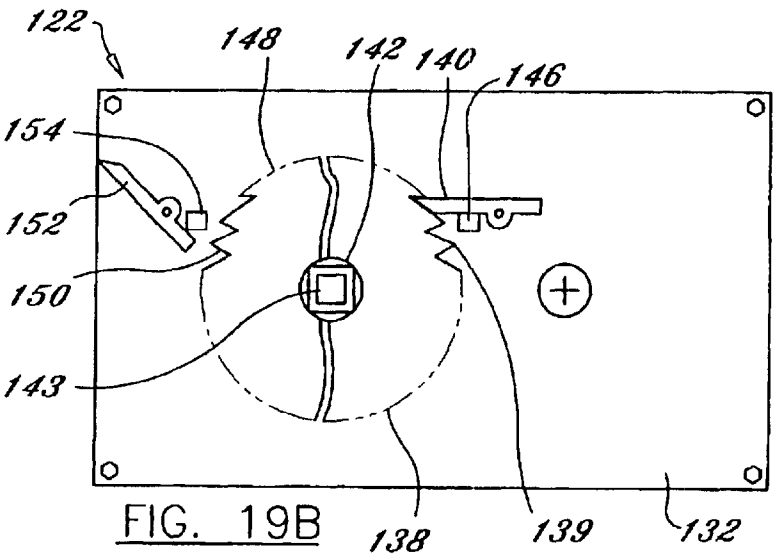
FIG. 19*b* is an enlarged side view of an drive assembly of an elevation device in accordance with the present invention.
Figure 19A:
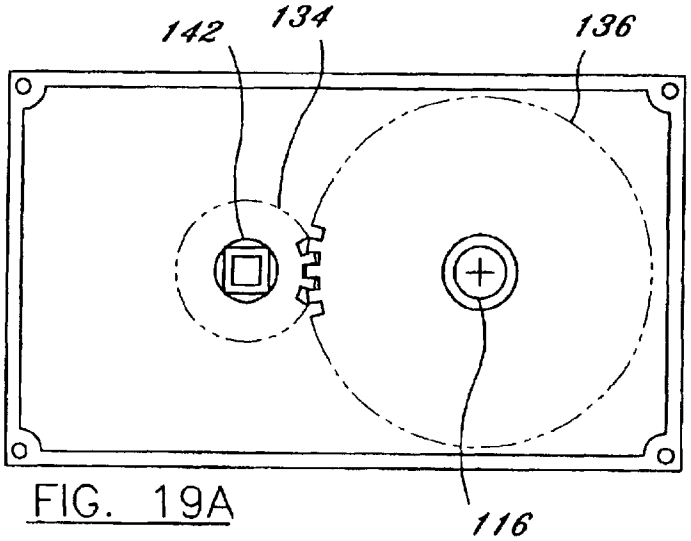
FIG. 19*a* is an enlarged front view of an drive assembly of an elevation device with a cover removed in accordance with the present invention.

With reference to FIGS. 19*a* and 19*b*, the drive assembly 122 preferably includes a case 130, a cover 132, a drive gear 134, a shaft gear 136, at least one ratchet gear, at least one catch, a crank shaft 142 and a ratchet arm 144. The case 130 is rigidly attached to one of the roller frames 20. A gear reduction drive includes the drive gear 134 and the shaft gear 136. The drive gear 134 and the shaft gear 136 are contained within the case 130 and protected by the cover 132. The cover 132 is capable of being rigidly attachable to the case 130 with any suitable attachment method.

The crank shaft 142 is pivotally retained by the case 130 and the cover 132. The drive gear 134 and the at least one ratchet gear are rigidly attached to the crank shaft 142 with any suitable attachment method. The ratchet arm 144 has a drive lug which is sized to be received by a drive cavity 143 formed in an end of the crank shaft 142. The ratchet arm preferably includes a ratchet drive with an extension arm attached to end thereof to improve leverage. The ratchet arm 144 is preferably removable from the crank shaft 142.

Figure 22:
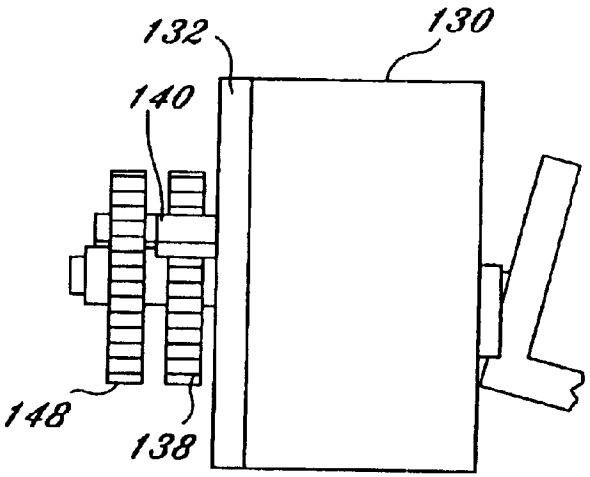
FIG. 22 is an enlarged side view of a drive assembly with two ratchet gears of an elevation device in accordance with the present invention.

The shaft gear 136 is rigidly attached to the drive shaft 116. The shaft gear 136 is larger than the drive gear 134 to provide a mechanical advantage for lifting a boat. The crank shaft 142 is rotated several times to provide a small amount of angular movement to the drive shaft 116. Each elevation device 114 may be used in a rear position as shown in FIG. 14 or a front position as shown in FIG. 14*a*. With reference to FIG. 22, the use of a front position and a rear position requires a front ratchet gear 148 and a rear ratchet gear 138. Using each elevation device 114 in a front or rear position only requires one ratchet gear. Preferably a front elevation support 135 is attached to each roller frame 20. A rear elevation support 141 would be used with an elevation device 114 located on a front of a boat landing apparatus.

The rear ratchet gear 138 has rear teeth 139 which are engaged by a rear catch 140. The rear catch 140 is supported by a rear stop 146. The rear ratchet gear 138, rear catch 140, and the rear stop 146 keep the pair of elevating arms 118 in a rear elevated orientation. The front ratchet gear 148 has front teeth 150 which are engaged by a front catch 152 and supported by a front stop 154. The front and rear ratchet gears are disposed adjacent each other. The front ratchet gear 148, front catch 152, and the front stop 154 keep the pair of elevating arms 118 in a front elevated orientation. Either catch is disengaged with its respective ratchet gear to enable a boat to be lowered: The ratchet arm 144 will be rotated several times to provide a small amount of angular movement to the drive shaft 116. Other devices may also be used to rotate the drive shaft 116 besides the drive assembly 122.

Figure 20:
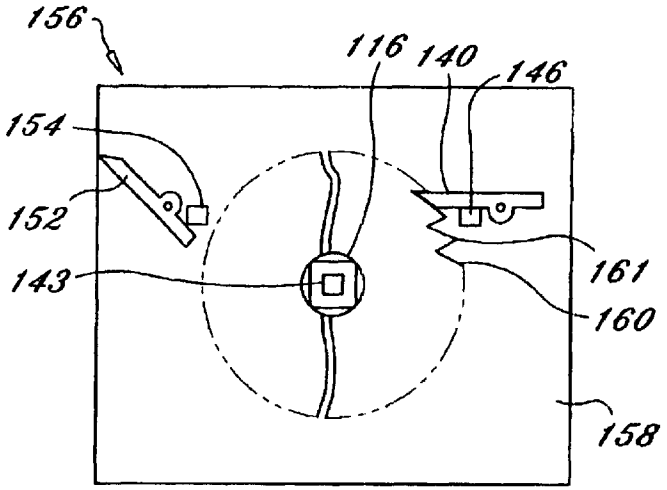
FIG. 20 is an enlarged front view of a direct drive assembly with a reversible ratchet gear of a direct elevation device in accordance with the present invention.
Figure 23:
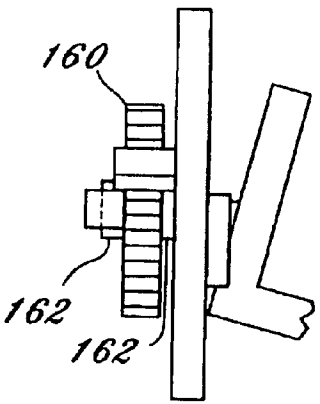
FIG. 23 is an enlarged side view of an direct drive assembly with a reversible ratchet gear of an elevation device in accordance with the present invention.
Figure 25:
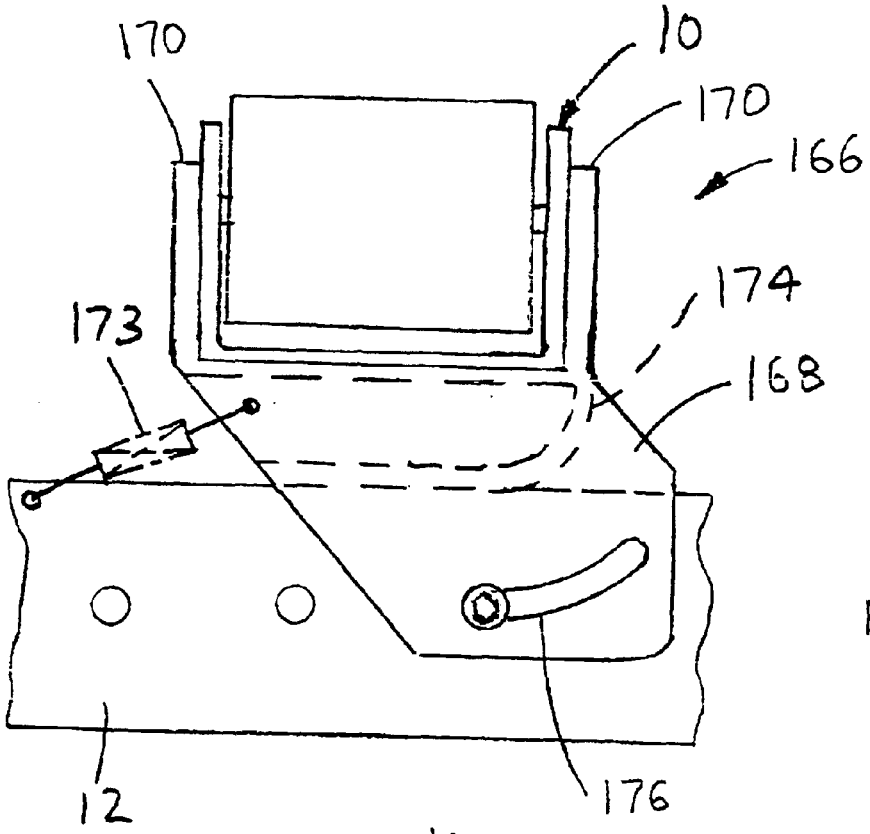
FIG. 25 is a front view of a surface pivot bracket of a third embodiment of a boat landing apparatus in accordance with the present invention.
Figure 26:
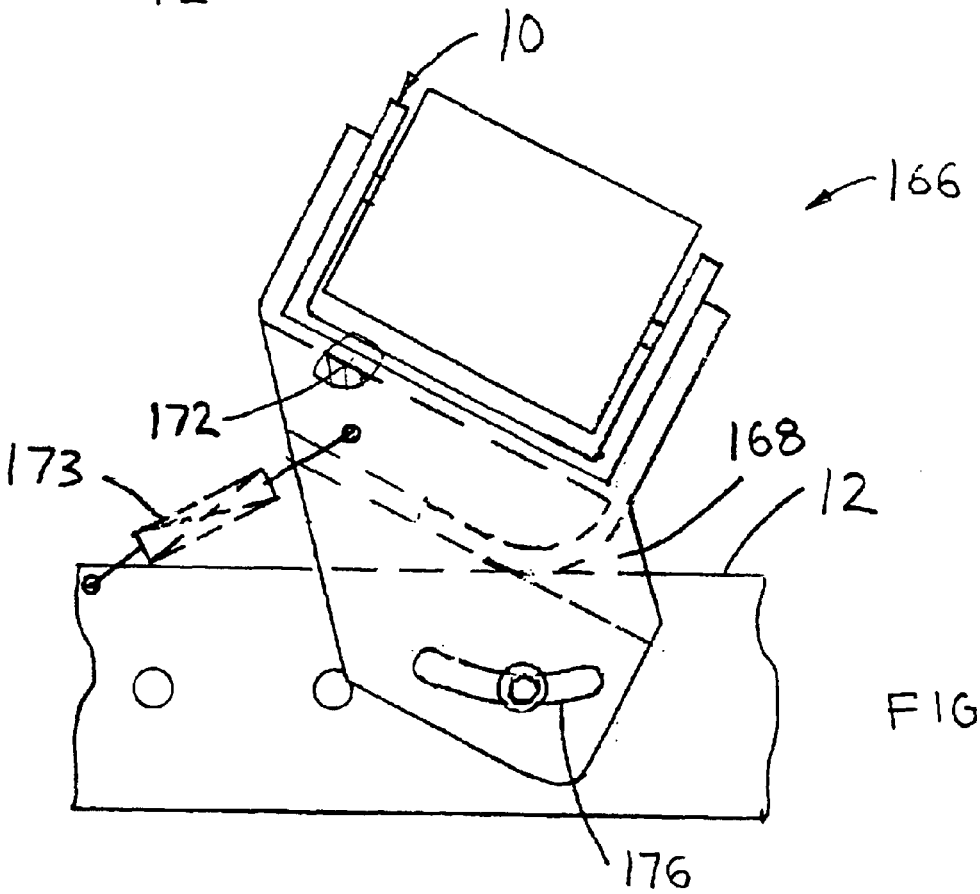
FIG. 26 is a front view of a surface pivot bracket in a pivoted position of a third embodiment of a boat landing apparatus in accordance with the present invention.
Figure 27:
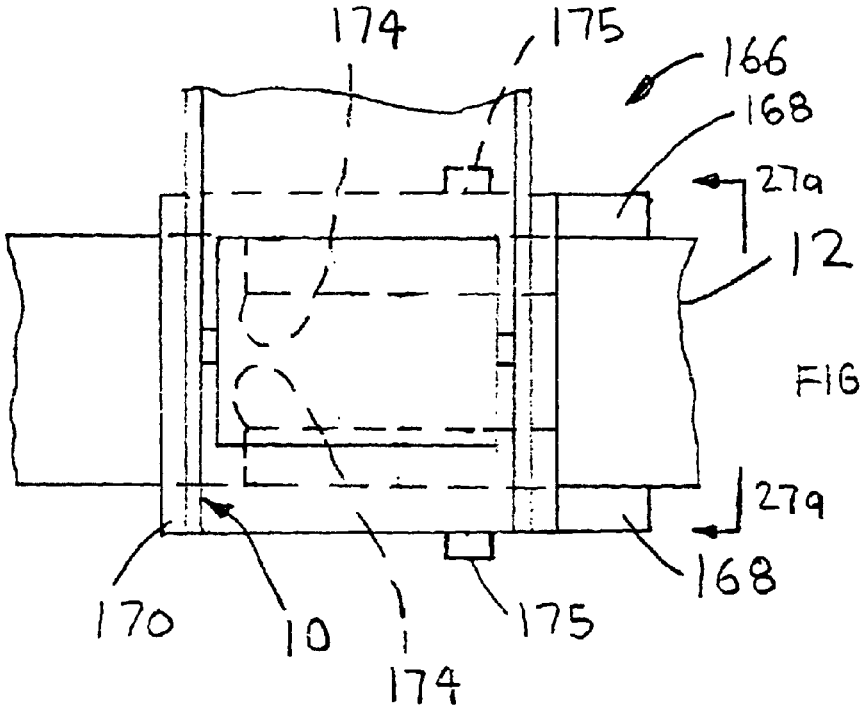
FIG. 27 is a top view of a surface pivot bracket of a third embodiment of a boat landing apparatus in accordance with the present invention.
Figure 31:
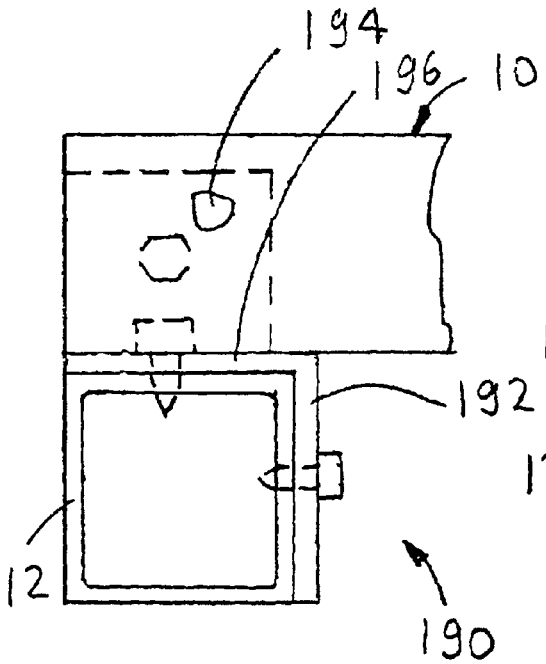
FIG. 31 is an end view of a cross bracket of a third embodiment of a boat landing apparatus in accordance with the present invention.
Figure 32:
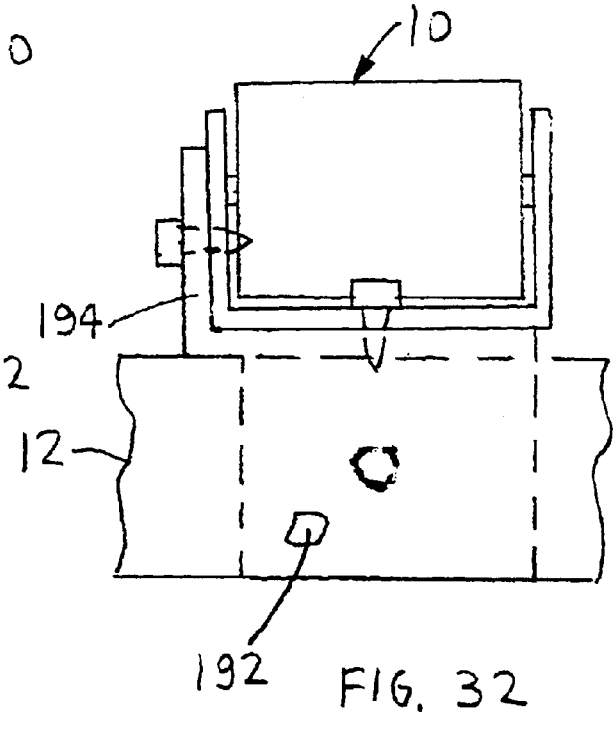
FIG. 32 is a front view of a cross bracket of a third embodiment of a boat landing apparatus in accordance with the present invention.

A direct drive assembly 156 is shown in FIGS. 20 and 23. The direct drive assembly 156 preferably includes a base plate 158, at least one ratchet gear, at least one catch, a crank shaft 142 and a ratchet arm 144. The base plate 158 is rigidly attached to one of the roller frames 20. The direct drive assembly 156 does not include the gear reduction of the drive assembly 122. The direct drive assembly 156 does not include a crank shaft 142, but the at least one ratchet gear is attached to the drive shaft 116.

A reversible ratchet gear 160 may be substituted for a front and rear ratchet gear, if a front and rear position of the elevating roller 120 is desired. The front and rear catch in conjunction with the front and rear stops are attached to the base plate 158. The reversible ratchet gear 160 has teeth 161 which engage the rear catch 140 as shown in FIG. 20 and engage the front catch 152 when reversed and reattached to the drive shaft 116. The reversible ratchet gear 160 preferably has a pair of hubs 162. Other devices may also be used to rotate the drive shaft 116 besides the direct drive assembly 156.

Figure 21:
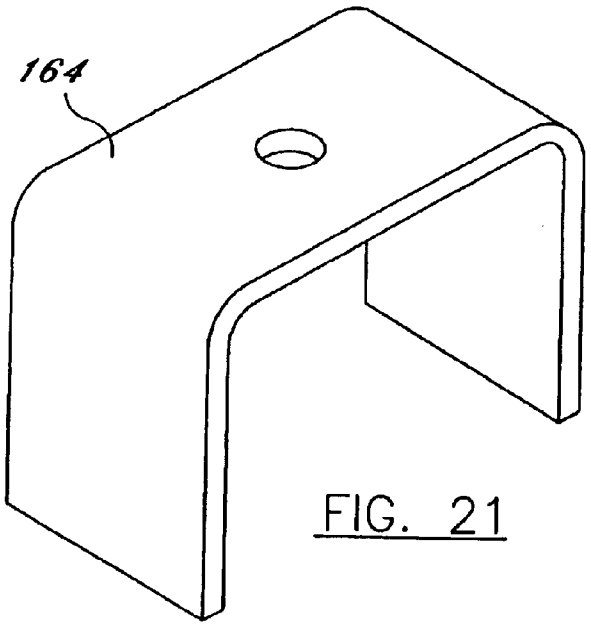
FIG. 21 is an enlarged perspective view of a stabilizing bracket in accordance with the present invention.
Figure 24:
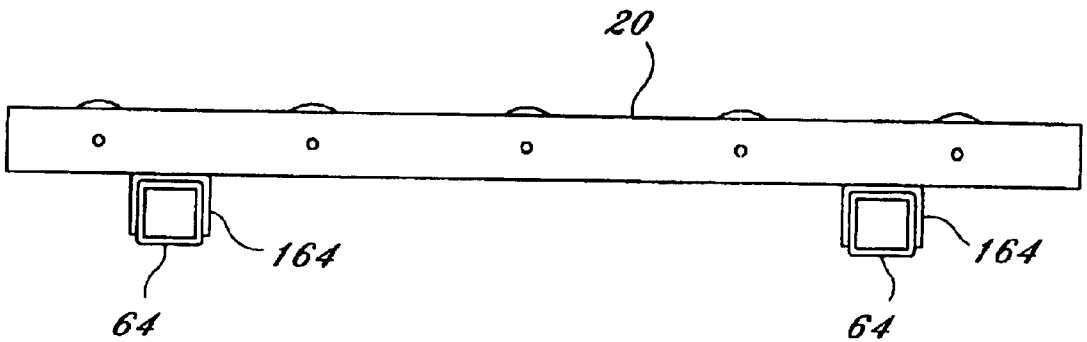
FIG. 24 is a side view of a roller assembly with a pair of stabilizing brackets attached thereto in accordance with the present invention.

A perspective view of a stabilizing bracket 164 is shown in FIG. 21. The stabilizing bracket 164 is sized to receive a cross member 64. With reference to FIG. 24, a pair of stabilizing brackets 164 are rigidly attached to a bottom of the roller frame 20. The stabilizing brackets 164 prevent the cross members 64 from pivoting relative to the roller frame 20. A single stabilizing bracket 164 may also be attached to each roller frame 20 to prevent pivoting of the cross members 64.

With reference to FIGS. 25–33, a third embodiment of the boat landing apparatus 3 includes a pair of roller assemblies 10, a pair of cross members 12 and four retention brackets. Each roller assembly 10 includes a plurality of rollers 18 pivotally retained in a roller frame 20. Each cross member 12 is mounted to substantially each end of each roller assembly 10 with a single retention device.

A first embodiment of the retention bracket is a surface pivot bracket 166. Each surface pivot bracket 166 is pivotally mounted to the cross member 12 and a single roller assembly 10 is retained on a top thereof. The surface pivot bracket 166 includes at least one lower leg 168, at least one upper leg 170, a base member 172, and at least one curved bearing surface 174. Each curved bearing surface 74 extends from inside of a single lower leg 168. At least one lower leg 168 extends downward from the base member 172. If two lower legs 168 are used, each lower leg 168 is spaced apart to receive the cross member 12.

A curved slot 176 is formed in each lower leg 168 such that it allows the at least one curved bearing surface 174 to carry the weight of a boat placed on the roller assembly 10. A fastener 175 is inserted through each curved slot 176 and attached to the cross member 12. The at least one upper leg 170 extends from a top of the base member 172. The at least one upper leg 170 is substantially perpendicular to the at least one lower leg 168. If two upper legs 170 are used, each upper leg 170 is spaced apart to receive the roller assembly 10. The roller assembly 10 may be attached to the base member 172 or at least one upper leg 170. At least one extension spring 173 is preferably used to retain the surface pivot bracket 166 such that the roller assembly 10 is normally parallel to the cross member 12.

A second embodiment of the retention bracket is a pivot support bracket 178. Each pivot support bracket 178 is pivotally mounted to the cross member 12 and an end of a single roller assembly 10 is retained on a top thereof. The pivot support bracket 178 includes two lower legs 180, at least one upper leg 182, a base member 184, and a support stop 186. Two lower legs 180 extend from a bottom of the base member 184. The two lower legs 180 are spaced apart to receive the cross member 12.

A pivot pin 188 or the like is inserted through the two lower legs 180 and the cross member 12. The ends of the pivot pin 188 may be peened over to retain thereof. The pivot pin 188 supports the weight of a boat placed on the roller assembly 10. The support stop 186 extends downward from the base member 184, such that an outside edge of the base member 184 is supported. The at least one upper leg 182 extends from a top of the base member 184. The at least one upper leg 182 is substantially perpendicular to the two lower legs 180. If two upper legs 182 are used, each upper leg 182 is spaced apart to receive the roller assembly 10. The roller assembly 10 may be attached to the base member 184 or at least one upper leg 182. At least one extension spring 185 is preferably used to retain the pivot support bracket 178 such that the roller assembly 10 is normally parallel to the cross member 12.

A third embodiment of the retention bracket is a cross bracket 190. The cross bracket 190 includes a lower attachment leg 192, an upper attachment leg 194 and a base member 196. The lower attachment leg 192 extends downward from the base member 196 and the upper attachment leg 194 extends upward from the base member 196, substantially perpendicular from the lower attachment leg 192. The cross member 12 is fastened to the lower attachment leg 192 and/or the base member 196. The roller assembly 10 is attached to the base member 196 and/or the upper attachment leg 194. A wedge spacer 22 may be inserted between a bottom of the roller assembly 10 before attachment to the cross bracket 190. The wedge spacer 22 enables the roller assembly 10 to have an inward tilt. The width of the third embodiment of the boat landing apparatus may be adjusted by aligning an opening in one of the retention brackets with one of the openings in the cross member.

Figure 34:
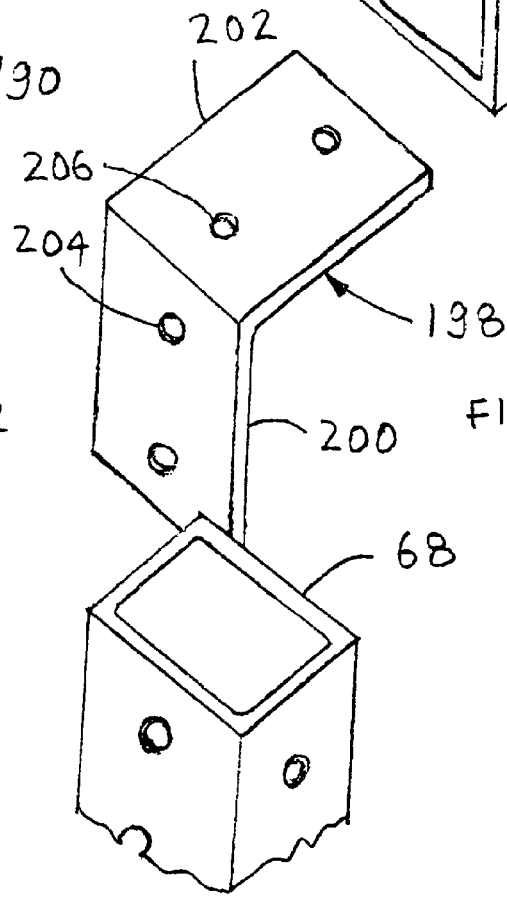
FIG. 34 is a perspective view of an angle bracket of a boat landing apparatus in accordance with the present invention.
Figure 35:
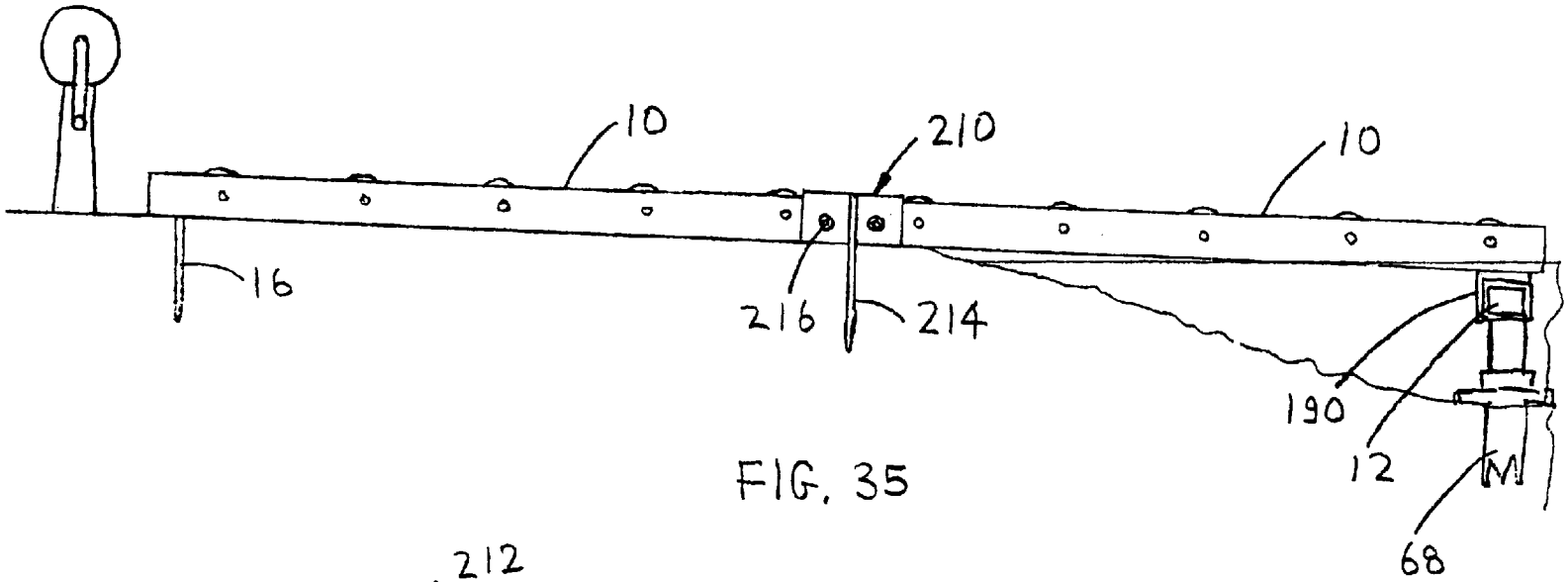
FIG. 35 is a side view of an in-line connector bracket retaining two roller assemblies of a boat landing apparatus in accordance with the present invention.
Figure 36:
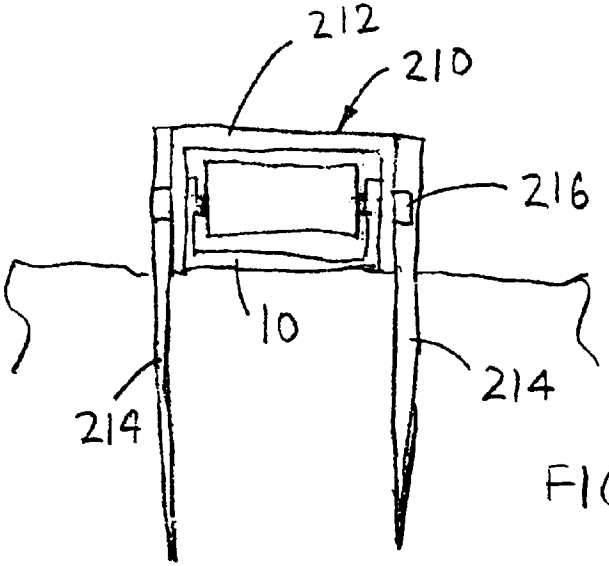
FIG. 36 is an end view of an in-line connector bracket retaining a single roller assembly of a boat landing apparatus in accordance with the present invention.

A single stake 16 may be inserted through an opening in the cross member 12 and/or roller assembly 10 for mounting of the third embodiment of the boat landing apparatus 3. With reference to FIG. 34, a support post 68 is mounted to a bottom of one of the cross members 12 with an angle bracket 198. The angle bracket 198 includes a first attachment leg 200 and a second attachment leg 202 that extends substantially perpendicular from the first attachment leg 200. Two first openings 204 are formed through the first attachment leg 200 for attachment to the support 68 with a fastener or the like. Two second openings 206 are formed through the second attachment leg for attachment to the cross member 12 with a fastener or the like.

Two roller assemblies 12 may be connected in series with an in-line connector bracket 210. The in-line connector bracket 210 includes a U-shaped bracket 212 and at least one stake 214 attached to a side of the U-shaped bracket. Preferably, the in-line connector bracket 210 is fastened to the sides of the roller assemblies with a fastener 216.

Figure 38:
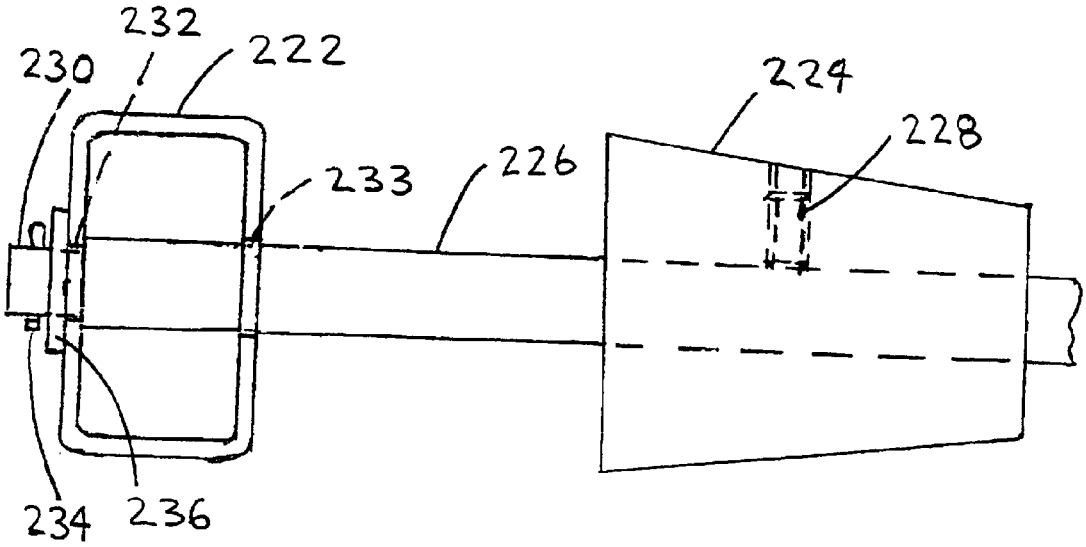
FIG. 38 is an enlarged partial end view of a fourth embodiment of a boat landing apparatus in accordance with the present invention.
Figure 27A:
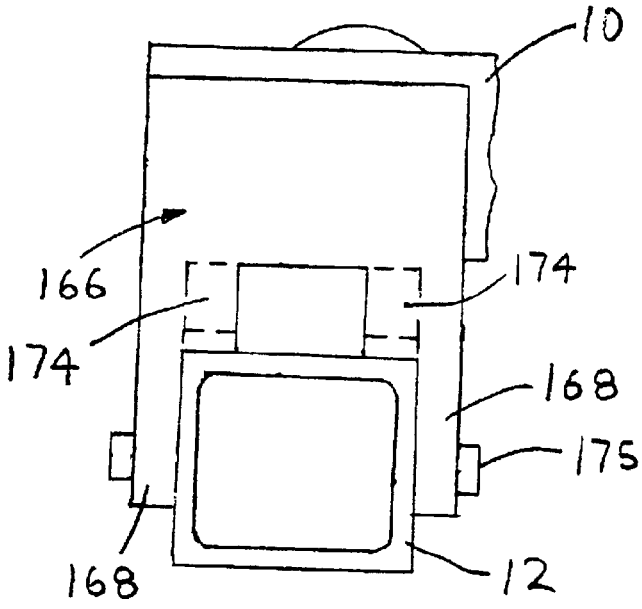
FIG. 27*a* is a front view of a surface pivot bracket of a third embodiment of a boat landing apparatus in accordance with the present invention.
Figure 28:
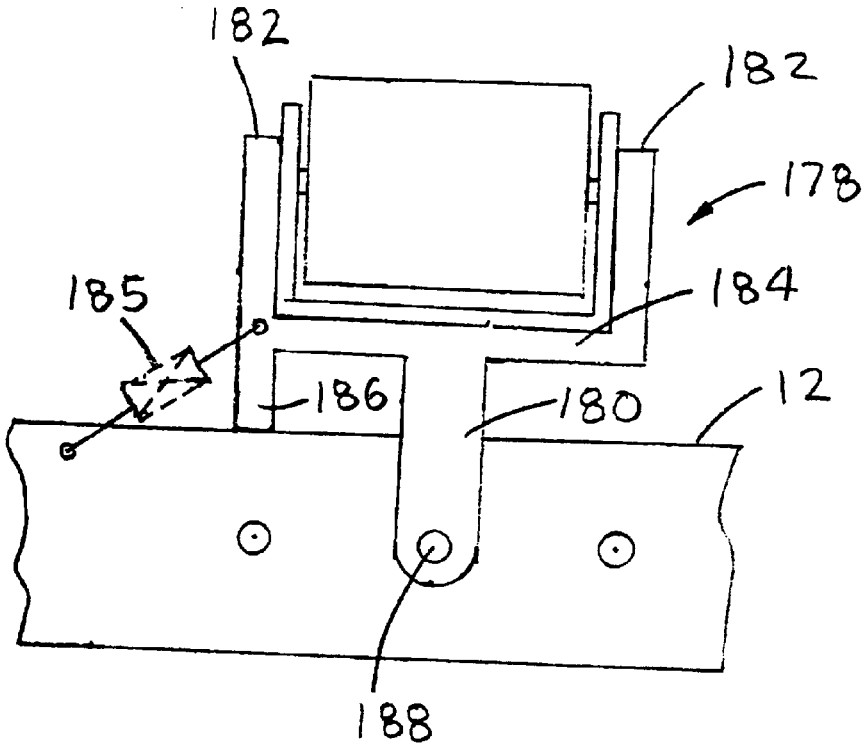
FIG. 28 is a front view of a pivot support bracket of a third embodiment of a boat landing apparatus in accordance with the present invention.
Figure 29:
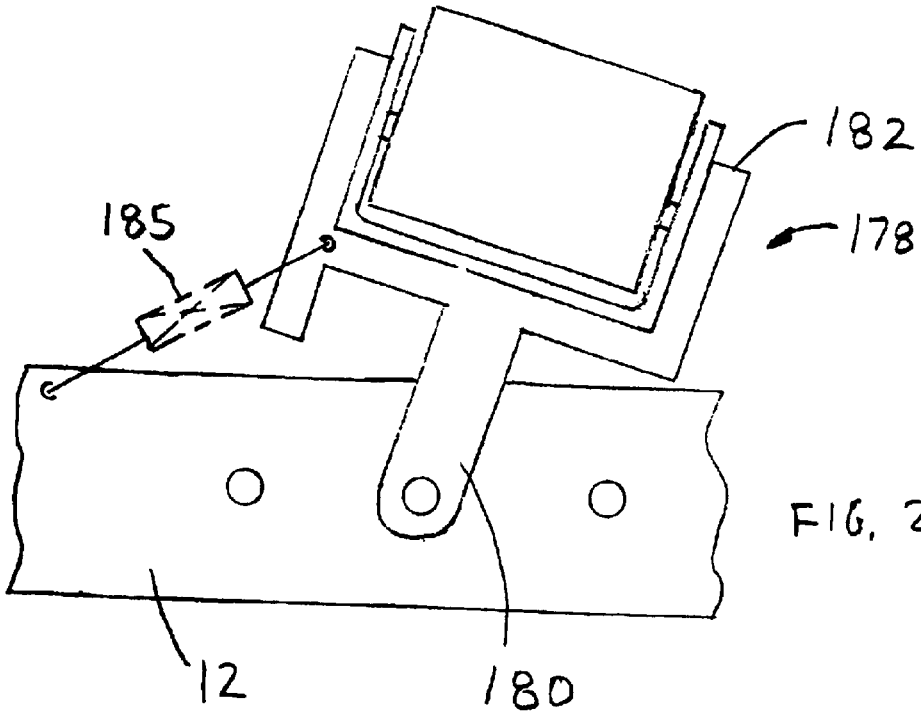
FIG. 29 is a front view of a pivot support bracket in a pivoted position of a third embodiment of a boat landing apparatus in accordance with the present invention.
Figure 30:
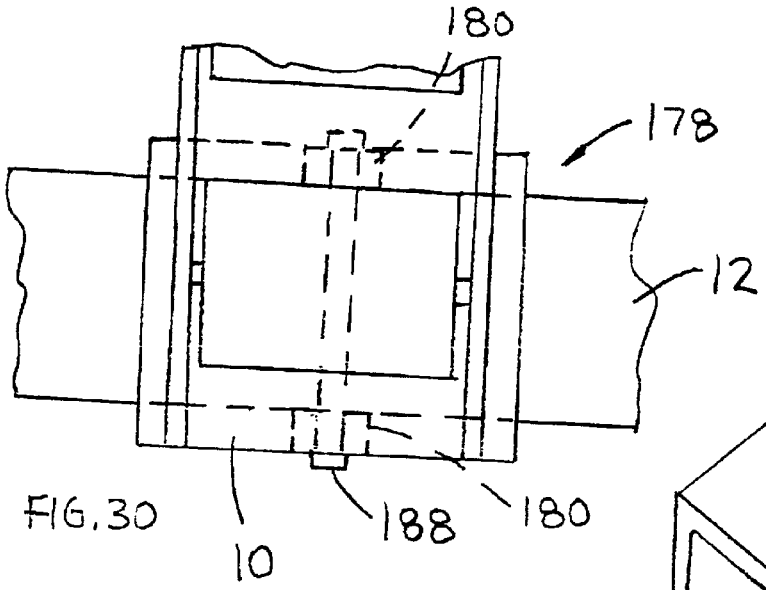
FIG. 30 is a top view of a pivot support bracket of a third embodiment of a boat landing apparatus in accordance with the present invention.
Figure 33:
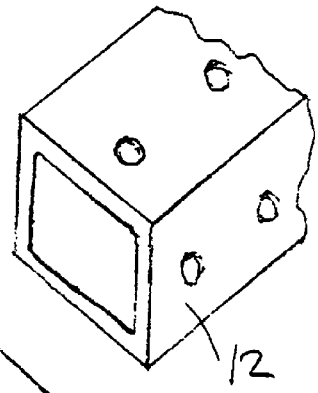
FIG. 33 is a top view of a cross bracket of a third embodiment of a boat landing apparatus in accordance with the present invention.
Figure 33:
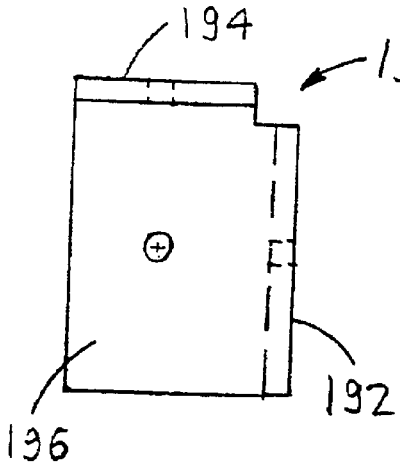
Figure 37:
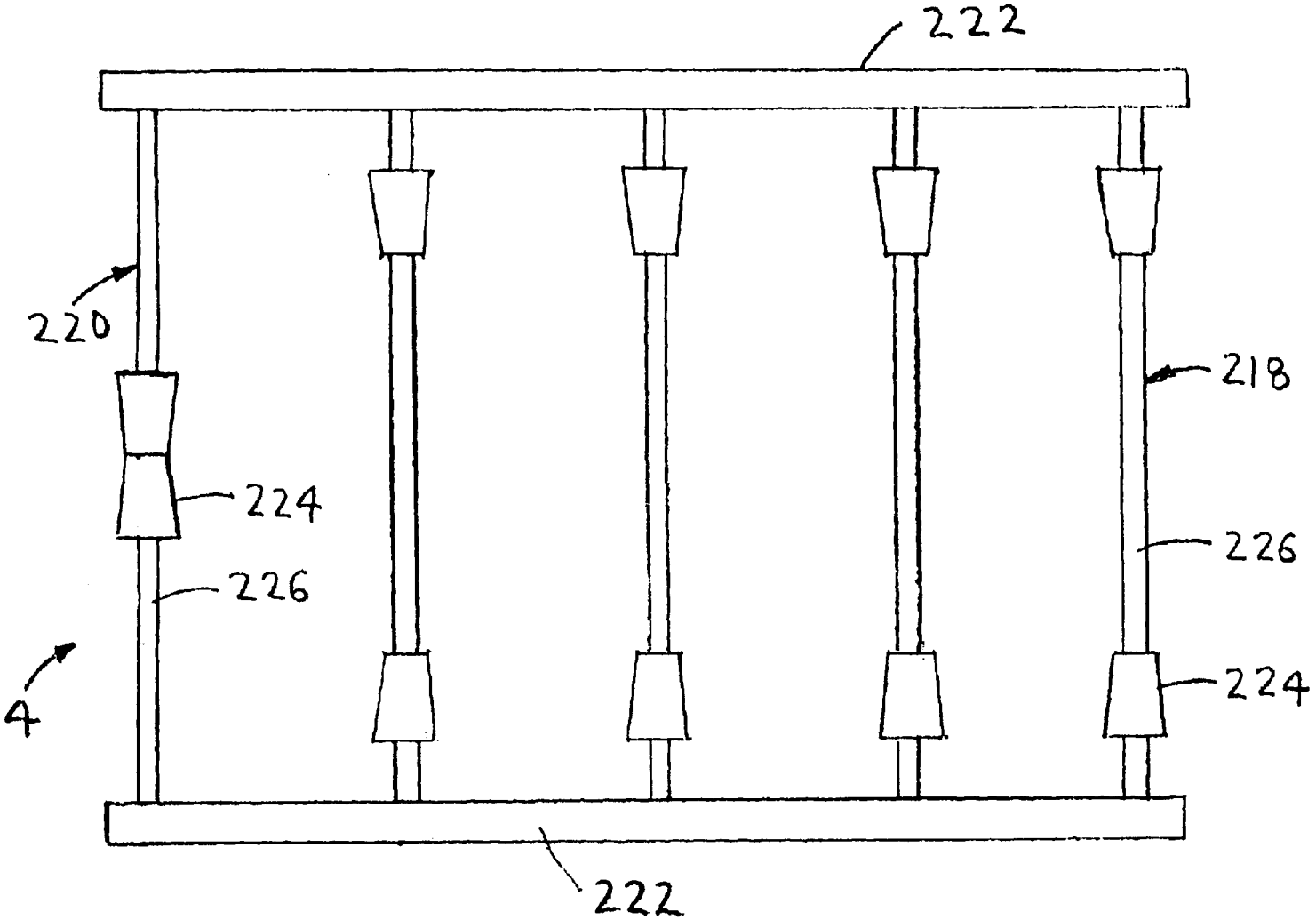
FIG. 37 is a top view of a fourth embodiment of a boat landing apparatus in accordance with the present invention.

With reference to FIGS. 37 and 38, a fourth embodiment of the boat landing apparatus 4 includes a plurality of roller axle assemblies 218, a starting roller axle assembly 220 and a pair of retention members 222. Each roller axle assembly is pivotally retained in the pair of retention members 222. Each roller axle assembly includes a pair of rollers 224 and an axle 226. Each roller 224 is preferably secured to an axle 226 with a set screw 228 or the like. Each roller 224 is preferably tapered inward to accommodate a water craft. Preferably, a stepped diameter 230 is formed on each end of the axle 226. A plurality of holes 232 and 233 are formed through each retention member 222. Each hole 232 is sized to pivotally receive the stepped diameter 230 of the axle 226. Each hole 233 is sized to pivotally receive the outside diameter of the axle 226. A cotter pin 234 or the like is used to retain the stepped diameter 230 in the retention member 222. A washer 236 is preferably inserted between the cotter pin 234 and the retention member 222. The plurality of rollers 224 support and guide a boat, which is being launched or pulled in.

Figure 39:
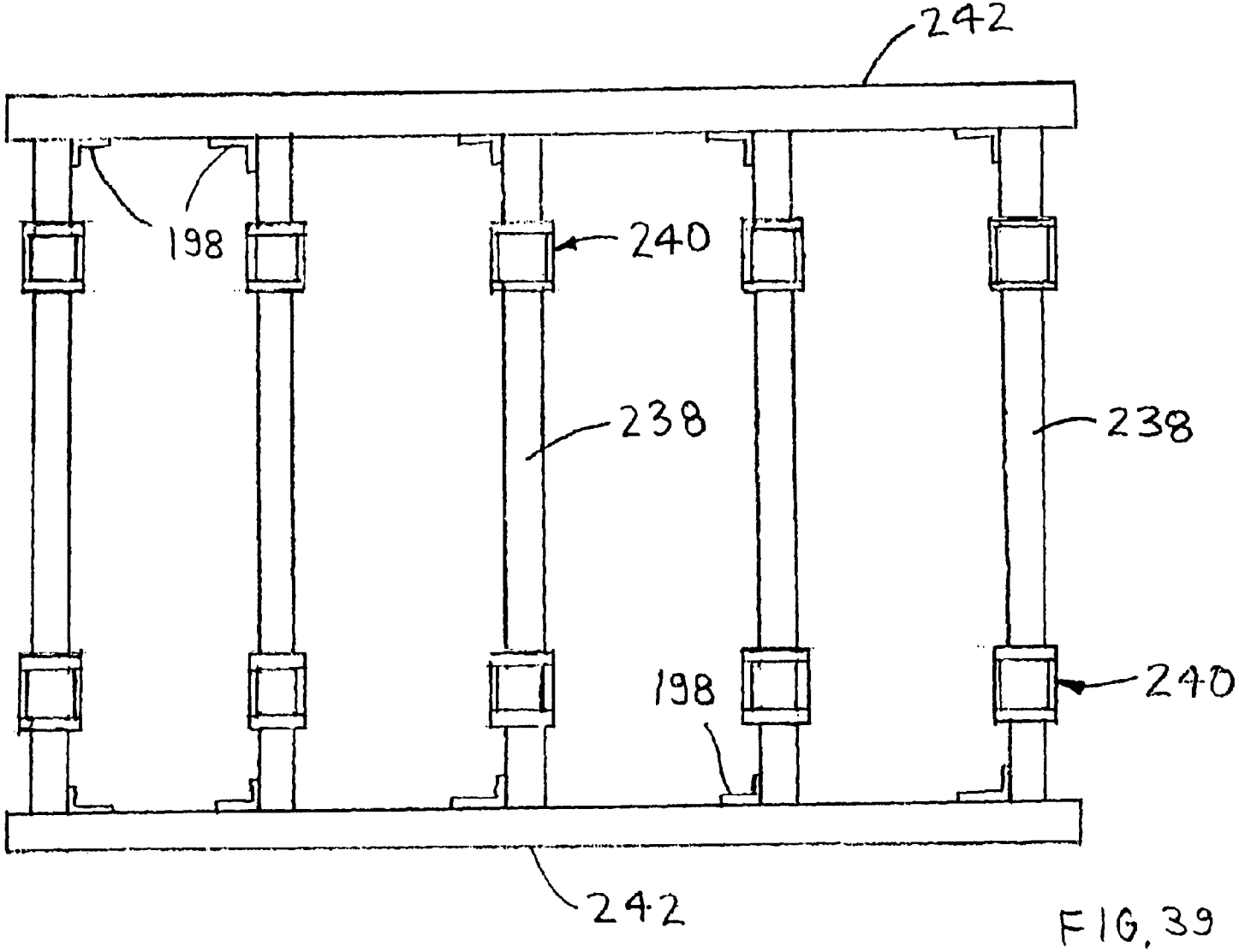
FIG. 39 is a top view of a fifth embodiment of a boat landing apparatus in accordance with the present invention.
Figure 40:
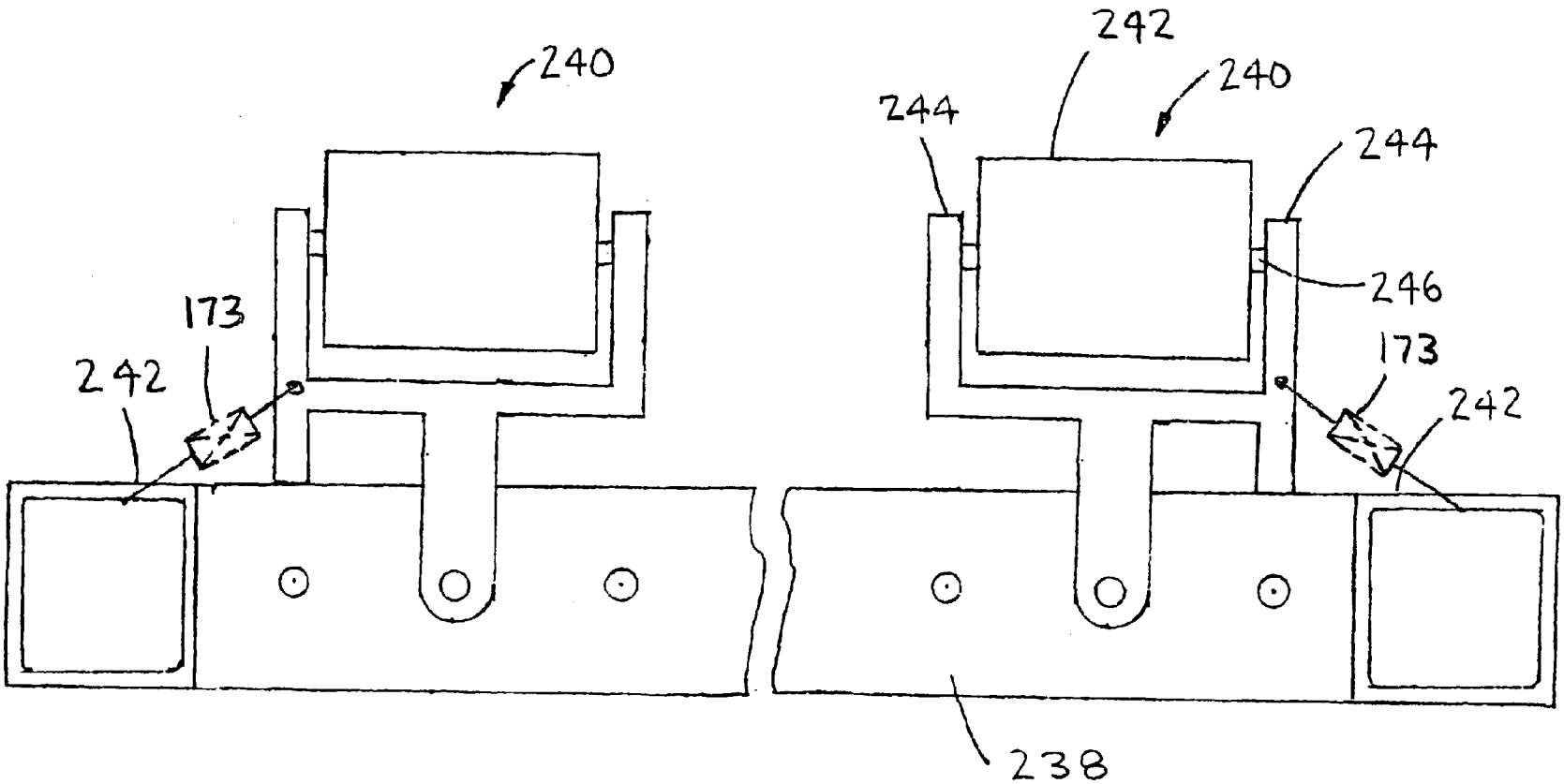
FIG. 40 is an enlarged end view of a fifth embodiment of a boat landing apparatus in accordance with the present invention.

With reference to FIGS. 39 and 40, a fifth embodiment of the boat landing apparatus 5 preferably includes a plurality of bracket support members 238, a plurality of pivot roller brackets 240, and a pair of lengthwise rail members 242. The cross member 12 may be substituted for the bracket support member 238. A pair of the pivot roller brackets 240 are pivotally attached to each bracket support member 238. Each end of each bracket support member 238 is preferably attached to a single lengthwise rail member 242 with a single angle bracket 198. However, other methods of attaching the bracket support members 238 to the pair of lengthwise rail members 242 may also be used, besides the plurality of angle bracket 198. The pivot roller bracket 240 is identical to the pivot support bracket 178 with the addition of a roller 242. The roller 242 is pivotally retained by two upper legs 244 and a pivot pin 246.

With reference to FIG. 41, a removable winch 250 may be used in combination with any embodiment of the boat landing apparatus 1–5. The removable winch 250 includes a removable winch assembly 252 and a retention tube. The retention tube is either a ground retention tube 254 or an attachable retention tube 256. The ground retention tube 254 includes a tubular body 260 and a top flange 262. The top flange 262 is attached to a top of the tubular body 260 with any suitable method and a bottom of the tubular body 260 is formed to a point 264 to facilitate insertion into the ground. The ground retention tube 254 is inserted into the ground adjacent the boat landing apparatus 1–5.

Figure 44:
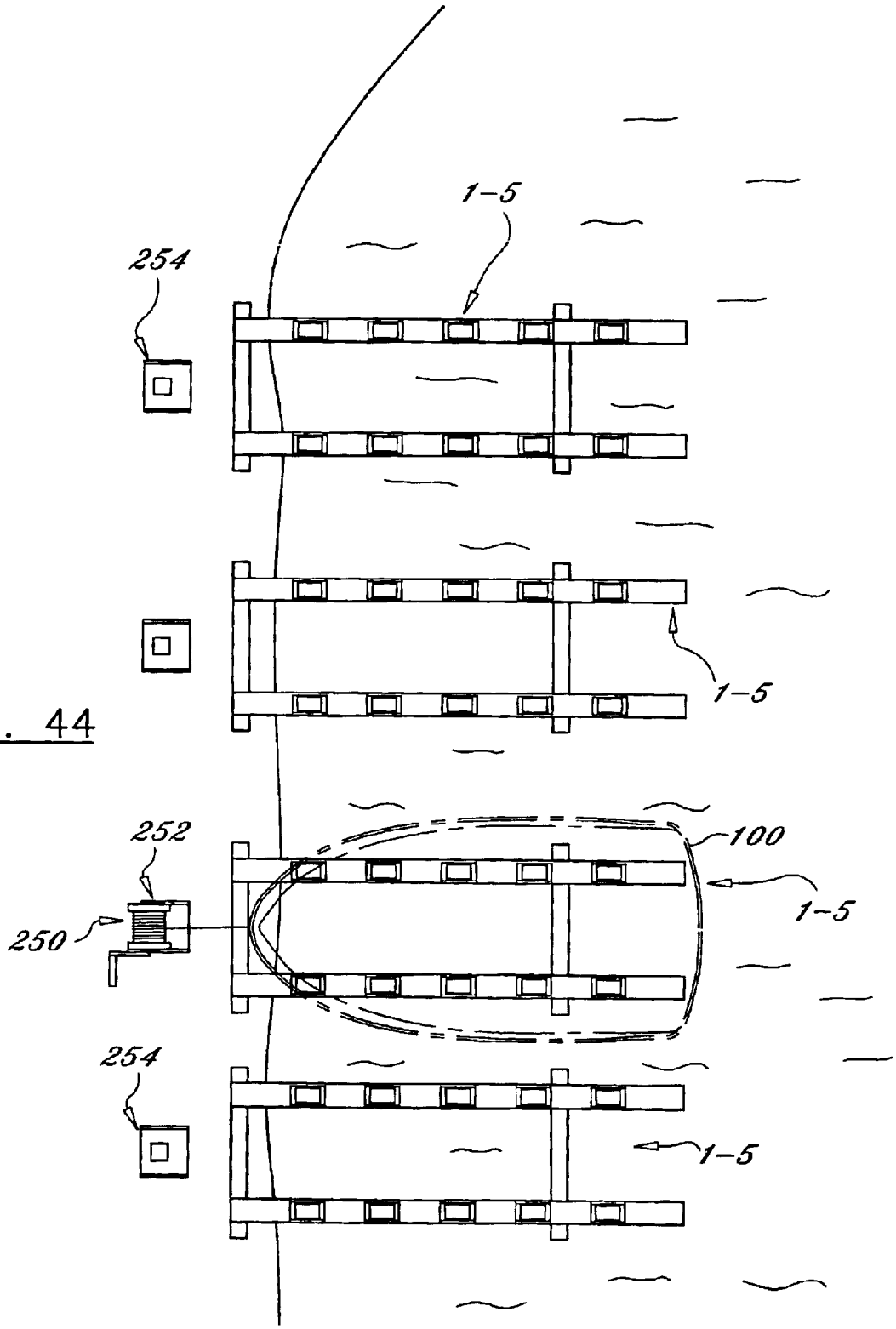
FIG. 44 is a top view of a plurality of retention tubes inserted into the ground adjacent a plurality of boat landing apparatuses in accordance with the present invention.

With reference to FIG. 44, the increased distance of the removable winch 250 to the boat landing apparatus 1–5 allows the boat 100 to be pulled in further. A plurality of ground retention tubes 254 may be inserted adjacent a plurality of boat landing apparatuses 1–5. The stability of the winch 258 is greater when the ground retention tube 254 is used, because of its isolation from the boat landing apparatus 1–5. Only one removable winch assembly 252 is needed to land a plurality of boats.

Figure 42:
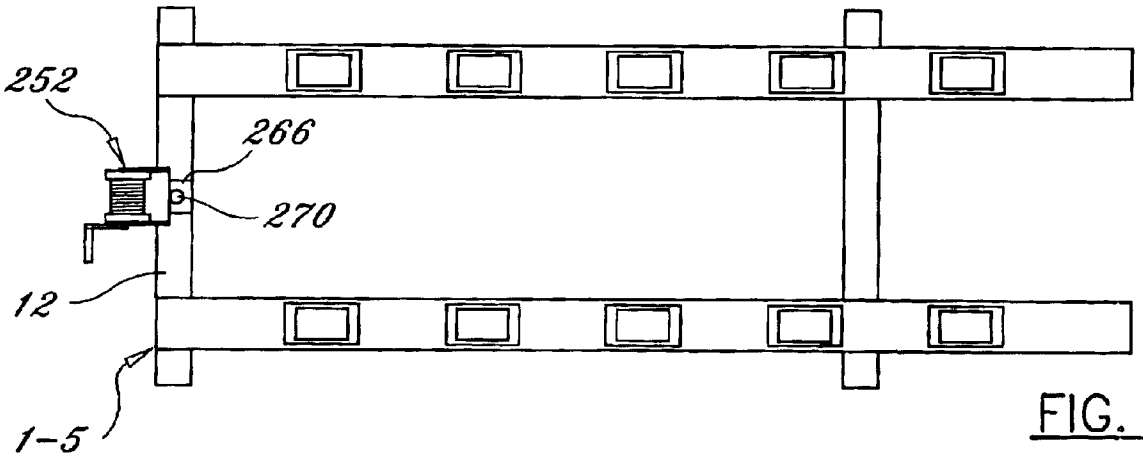
FIG. 42 is a top view of a removable winch attached to a boat landing apparatus in accordance with the present invention.
Figure 43:
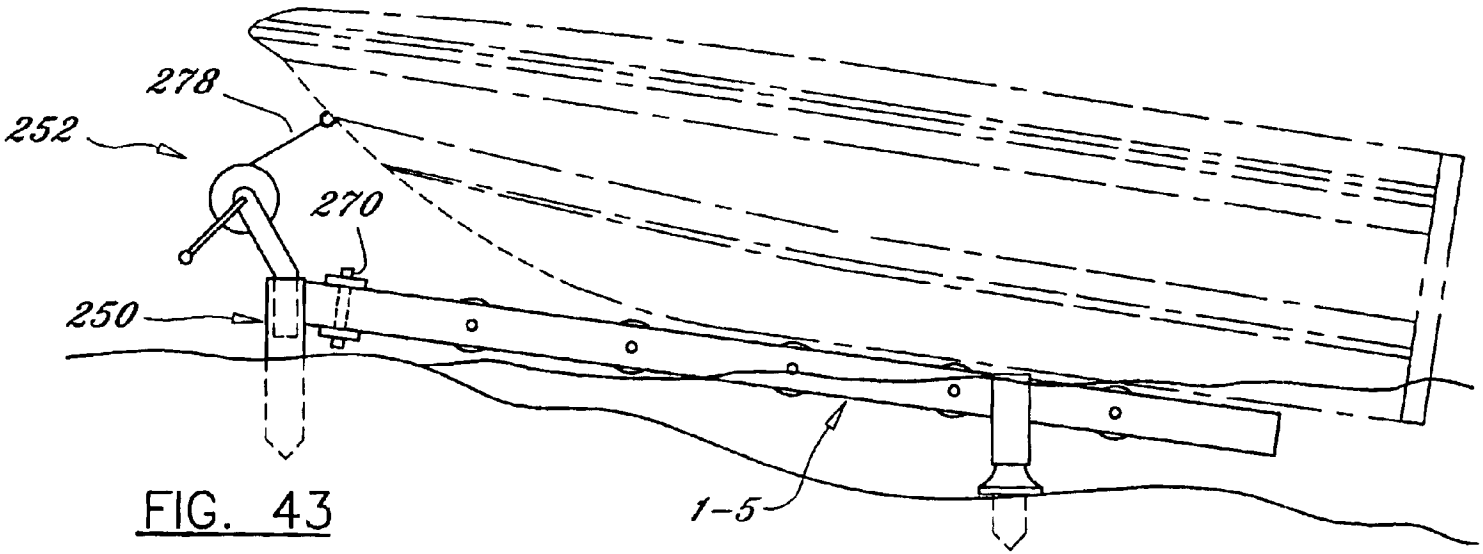
FIG. 43 is a side view of a removable winch attached to a boat landing apparatus in accordance with the present invention.
Figure 45:
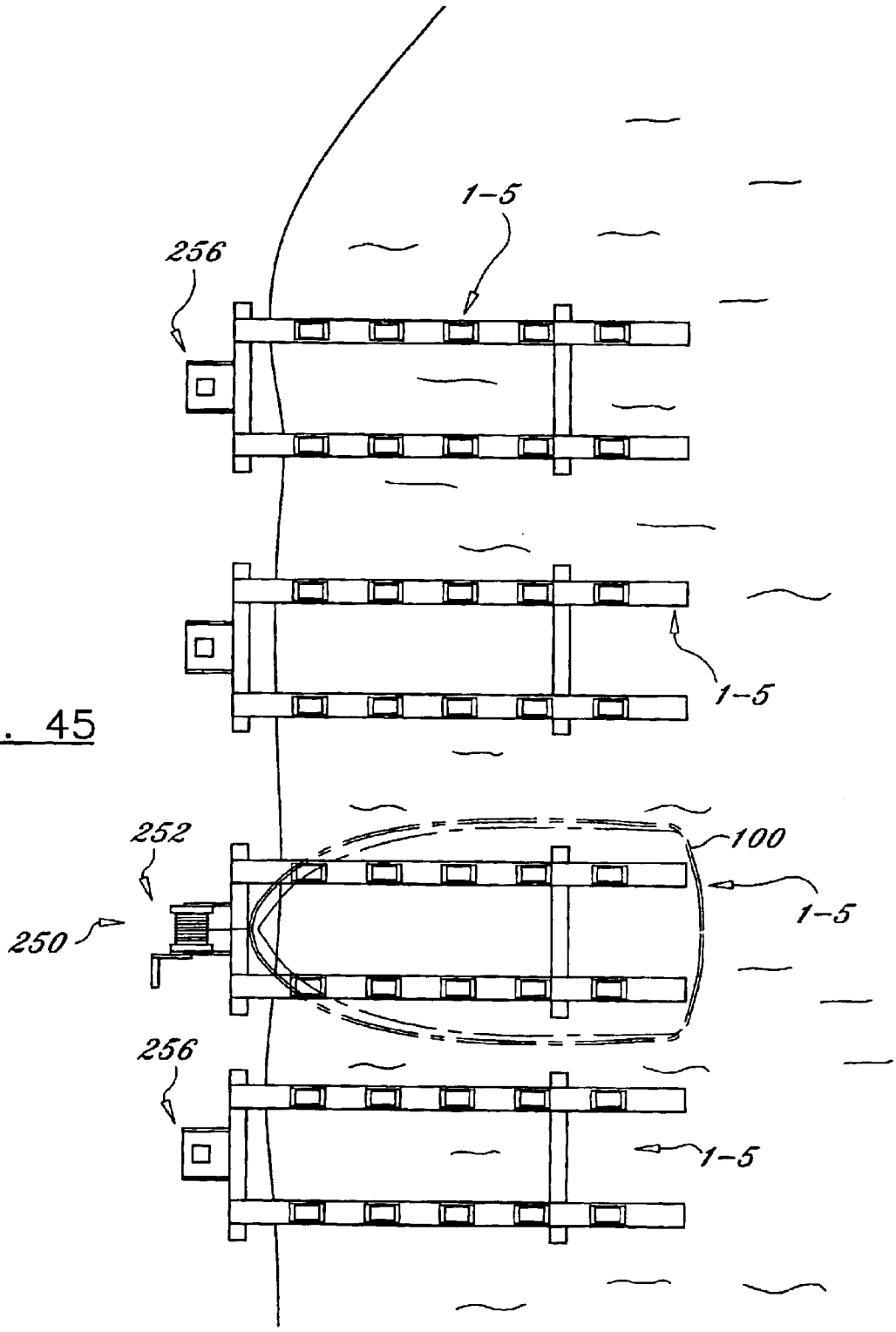
FIG. 45 is a top view of an attachable retention tube secured to each one of a plurality of boat landing apparatuses in accordance with the present invention.

With reference to FIGS. 42 & 43, the attachable retention tube 256 preferably includes a tubular body 260 and at least one attachment flange 266. The at least one attachment flange 266 is attached to a top of the tubular body 260 with any suitable method and a bottom of the tubular body 260 is formed to a point 264 to facilitate insertion into the ground. A space between the two attachment flanges 266 is sized to receive the cross member 12 of the boat landing apparatus 1–5. A retention hole 268 is formed through each attachment flange 266 and the cross member 12 to receive a fastener 270 or the like. The attachable retention tube 256 is preferably inserted into the ground. Cranking the winch assembly 252 puts most of the stress on the ground, instead of the boat landing device 1–5. With reference to FIG. 45, an attachable retention tube 256 is secured to each one of a plurality of boat landing apparatuses 1–5. Only one removable winch assembly 252 is needed to land a plurality of boats.

The removable winch assembly 252 preferably includes a winch 258 and a retention projection 261. The retention projection 261 extends from a bottom of the winch 258. The retention projection 261 includes a winch leg 263 and a retention leg 265. One end of the winch leg 263 extends downward from the winch 258 and the retention leg 265 extends downward from the other end of the winch leg 263. The retention leg 265 is sized to be received by either retention tube. A leg pin hole 269 is preferably formed through the retention leg 265. A retainer pin hole 271 is formed through the attachable retention tube 256. The leg pin hole 269 and the retainer pin hole 271 are sized to receive a retention pin 267.

The winch 258 includes a retention yoke 272, a reel 274, a crank 276, a racket mechanism (not shown) and a line 278. The reel 274 is pivotally retained in the retention yoke 272 and the line 278 is retained on the reel 274. The crank 276 extends from and end of the reel 274 and the rotation thereof is constrained by the racket mechanism. However, other types of winches may also be used, including motorized types.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method of combining a removable winch with a boat landing apparatus, comprising the steps of:

providing a boat landing apparatus capable of landing a water craft;

providing a winch that is capable of reeling in a water craft; and providing a retention tube that is capable of removably receiving said winch, attaching said retention tube to said boat landing apparatus, inserting an end of said retention tube into the ground.

2. The method of combining a removable winch with a boat landing apparatus of claim 1, further comprising the step of:

forming at least one attachment flange on a top of said retention tube.

3. A method of combining a removable winch with a boat landing apparatus, comprising the steps of:

providing a boat landing apparatus capable of landing a water craft;

providing a winch that is capable of reeling in a water craft; and providing a retention tube that is capable of removably receiving said winch, inserting said retention tube into the ground adjacent said boat landing apparatus.

4. A method of combining a removable winch with a boat landing apparatus, comprising the steps of:

providing a boat landing apparatus capable of landing a water craft;

providing a winch that is capable of reeling in a water craft; and providing a retention tube that is capable of removably receiving said winch, forming at least one attachment flange on a top of said retention tube, attaching said at least one attachment flange to said boat landing apparatus, inserting an end of said retention tube into the ground.

* * * * *